United States Patent [19]

Chiappe et al.

[11] Patent Number: 5,016,420

[45] Date of Patent: May 21, 1991

[54] APPARATUS AND METHOD FOR PACKAGING GROUPS OF ARTICLES

[75] Inventors: Wayne T. Chiappe, Hinsdale, Ill.; Larry R. Ambrose, Apopka, Fla.; Donald P. Dalmon, Winter Park, Fla.; Bernard R. Juskie, Apopka, Fla.; Raymond E. Godwin, Orlando, Fla.

[73] Assignee: Sardee Industries, Inc., Alsip, Ill.

[21] Appl. No.: 449,311

[22] Filed: Dec. 8, 1989

Related U.S. Application Data

[63] Continuation of Ser. No. 366,284, Jun. 13, 1989, abandoned, which is a continuation of Ser. No. 251,651, Sep. 30, 1988, abandoned.

[51] Int. Cl.[5] ..... B65B 9/13; B65B 9/14; B65B 7/08; B65B 35/40

[52] U.S. Cl. ..... 53/138.1; 53/532; 53/542; 53/567; 53/254; 53/378

[58] Field of Search ..... 53/567, 542, 532, 254, 53/379, 137, 371, 378

[56] References Cited

U.S. PATENT DOCUMENTS

| | | | |
|---|---|---|---|
| 4,079,572 | 3/1978 | Vande Castle | 53/379 X |
| 4,165,595 | 8/1979 | Pilley et al. | 53/567 X |
| 4,395,864 | 8/1983 | Anderson et al. | 53/532 |
| 4,419,854 | 12/1983 | Okada et al. | 53/567 X |
| 4,442,652 | 4/1984 | Wakamatsu et al. | 53/542 X |
| 4,442,654 | 4/1984 | Wakamatsu et al. | 53/542 X |
| 4,553,376 | 11/1985 | Okada et al. | 53/567 X |
| 4,587,689 | 5/1986 | Nakamura | 53/567 X |
| 4,730,437 | 3/1988 | Benno | 53/567 X |
| 4,765,451 | 8/1988 | Labombarde | 53/542 X |
| 4,771,510 | 9/1988 | Kawai | 53/567 X |

*Primary Examiner*—Horace M. Culver

*Attorney, Agent, or Firm*—Lockwood, Alex, FitzGibbon & Cummings

[57] ABSTRACT

Disclosed is a machine for packaging articles, such as can ends, in a sleeve drawn from a roll of continuous sleeve material. Means are disclosed for feeding the can ends to a packaging location, for segregating the can ends into package-size groups and for inserting the groups into the sleeves. The machine further includes means for feeding the sleeve material to the packaging location, means for retaining the sleeve material at the packaging location and means for heating and severing the sleeve material to form an individual sleeve. Means for forming and sealing end-flaps on the contents containing sleeve is also disclosed.

70 Claims, 15 Drawing Sheets

238
302
240
230
252
254
256

10
302
244
262
239
240
241
242
260
258
234
266
264
80
230
52
232
64
236
248
246
250
90

10

595
592
594
596
444
554
560
"P"
558
590
588
559
574
562
566
556
564
585
568
576
586
580
578
90
584
573
571
582
570
572
584

550
417
444
552
550

488
484
480
415
436
440
474
491
492
472
476
478
486
482
490

APPARATUS AND METHOD FOR PACKAGING GROUPS OF ARTICLES

This application is a continuation of application Ser. No. 366,284, filed June 13, 1989, and now abandoned, which is in turn a continuation of application Ser. No. 251,651, filed Sept. 30, 1988, and now abandoned.

BACKGROUND OF THE INVENTION

The present invention relates generally to article packagers and methods, and more particularly, to an apparatus and method for packaging individual articles, such as can ends for example, in groups within sleeve for protection during storage and shipment.

While the apparatus and method are applicable to other mass produced components, a primary application of the invention is that of packaging can ends in the can manufacturing and filling industry.

The metal packaging industry is one of the major industries in the United States. Measured by the volume of products produced and sold, its statistics border on the staggering. At the present writing, well over 72 billion beer and beverage cans are manufactured, filled with product and sold every year in the United States, and approximately an equal number of cans are filled and sold elsewhere in the world every year. This incredible number is constantly increasing because of the demand for canned products of all kinds.

Most cans now sold for soft drinks and other beverages, such as beer, are of the so-called two piece type, although billions of so-called three piece beer and beverage cans are still manufactured. By a "two piece" can is meant a can wherein the cylindrical side walls of the can and what becomes the bottom of the can in use are formed in a single operation, i.e., they emerge from the manufacturing process as a unit. The second piece is the other can end, lid, or cover; in many cases this end or cover is a part which itself includes not only the end panel and a margin adapted for seaming, but also includes a separately made tab or equivalent form of easy opening device.

So-called three piece "cans" are made from cylindrical bodies formed from flat sheet materials and secured along a side seam to form the cylinder. Such can bodies are then flanged at both ends, and one of the ends is closed off by a separately manufactured can end which is sealed in fluid-and gas-tight relation to the can body at the point of manufacture. In the case of both two piece and three piece cans, the elements made by the manufacturer are transported to another location, which may be nearby or quite remote, for filling, pasteurization where indicated, further storage, and/or transport to market.

Consequently, while can bodies and can ends are made in a single location, the ends and bodies must be shipped as separate units to the location at which the cans are filled and the ends secured to the can bodies. Both can bodies and can ends are made at enormous speeds. However, even if the rates of component manufacture were identical, can ends would still be stored transiently between the time they are manufactured and the time the ends are seamed onto the finished product. This is for quality control reasons and also because the "compound" which lines the periphery of the can end must cure and/or allow solvents or other volatile components to dissipate therefrom before seaming. Therefore, the ends cannot be seamed to the bodies immediately; this requires that the ends be packaged; their source, i.e., the machine in which they were made is then desirably kept track of for quality control purposes.

It is now customary in the can industry to manufacture can ends in a so-called module wherein the end shells are formed from sheets of aluminum or other metal at a high rate, following which the shells are curled and lined with "compound" to facilitate seaming. Thereafter, the lined shells are advanced to so-called conversion presses wherein opening tabs are affixed by the formation of integral rivets, and wherein a characteristic score line forming a portion of the can end panel is imparted so the can readily tear out a portion of the end panel.

It has been customary in the industry up until now to package an array or "stick" of these can ends in a paper sleeve which then is closed off or sealed against dirt and dust at both ends. The stick or package of ends thus segregated and protectively packaged is transported, along with other packaged arrays of ends, to storage for subsequent use or more or less directly to the filling location.

Up until now, the practice of packaging such can ends has been accomplished by so-called manual methods or, in some cases, semi-automatic methods. In the manual method, a continuous array of stacked ends is forwarded to a given location and subdivided into a stick, usually some 36 to 50 inches in length, and generally comprised of some 400 ends, more or less. This stick is then inserted manually into a tube or sleeve of kraft paper having one open end; after filling, the operator closes off the sleeve by folding and/or taping and moves this packaged stack of can ends into a bin or other storage means.

In a so-called semi-automatic end packer or bagger, a similar operating sequence is carried out as so-called continuous arrays or "strings" of ends enter the machine and are counted and then separated into individual "sticks" by a splitting mechanism and separating cylinder and rod assembly. In this case, the operator removes an individual bag from a storage area and places the bag on a loading horn associated with the inbound lane toward which the can ends are being advanced. If several lanes are in operation, several horns are present and the operator places a bag with its open end over the indicated horn from time to time.

Thereafter, the operator signals the machine, by actuating a button, for example, and the bag is clamped in position with a part of its open end on the horn, and a secondary or loading cylinder is actuated, feeding the group of ends into the bags.

With this system, the bags may be clamped automatically, but the bags filled with ends must be manually removed and succeeding, pre-formed bags must then be placed on the appropriate horn for retention in place and insertion of a stick of ends of the desired length.

Because of the difficulty of performing this operation at high speed, and in particular the need to continually remove packages of ends, the operation of even a semi-automatic end bagger can become tedious and labor-intensive. Moreover, the capacity of such machines is limited and there are other drawbacks associated with these systems.

Referring now to another practice in the can industry, as pointed out above, the individual can ends are made on a particular shell press. After this, the ends are arrayed in a stack for feeding to one or more work load regulators, from which they are forwarded to a "conversion" or "tab" press. From here, the ends are again arrayed and forwarded to the end counter/packager just described. For purposes of quality assurance, it is considered at least desirable and in some cases necessary that the individual can ends made from time to time be traceable to one or more particular machines wherein such ends were made, so that if one or more ends in a group proves to be of faulty manufacture, a temporary "quarantine" may be imposed on all ends emanating from such press until the cause of product defects has been located and corrected.

Therefore, it is desirable in handling can ends that individual source accountability for each package of ends be maintained. In using manual or semi-automatic baggers, this requires coding of a bag to signify the associated machines in which it was produced and, according to present practice, maintaining all ends emanating from such press in a particular bin or other storage area so that the foregoing quality control accountability may be carried out.

Because of the shortcomings of the prior art methods just described, it is apparent that there is a need for further automation of end counting and packaging in the can industry. Significant improvements in speed, reliability, and reduced labor costs could be achieved by providing a fully automatic end packager, preferably associated with an automatic end counter. By "fully automatic" is meant one wherein plural arrays of can ends could be subdivided into groups and be continuously fed to a packer which would itself continually advance bag stock in sleeve or other form, and not only position the sleeve stock for bagging but also achieve the entire bagging operation (including closure of first one end and then the other, and removal and storage of the finished package from the machine) without human intervention.

According to the invention, an automatic end packager, has been developed; it is preferably associated in use with an end counter/separator, is capable of taking individual stacks from one or more storage areas or inbound "lanes" picking up the ends in arrays or groups and placing them in a group receiving area wherein they may be advanced under the control of an insertion unit to the interior of a sleeve formed during another portion of the machine cycle. The sleeve is taken from a continuous supply of sleeve stock, advanced by a shuttle mechanism and transiently affixed to a positioner which secures the sleeve while it is filled; end flaps are formed on the package ends and the package thus formed is removed to a storage area on a continuous basis.

In view of the failure of the prior art to provide such an automatic article counter/separator and packager unit, it is an object of the present invention to provide a fully automatic packager for an array of manufactured articles or components.

Another object of the invention is to provide an automatic packager for identical articles, such as can ends, which are manufactured at high speed and which must be packaged for transient storage and/or transport.

A further object of the invention is to provide an automatic packager for can ends or like materials which is capable of being used with new or existing machinery for arraying and subdividing groups of such manufactured articles.

A still further object of the invention is to provide an automatic end packager which includes a plurality of individual stations each operable in sequence to position, advance, and insert a group of articles within a sleeve which is fed from a continuous supply of material tensioned and supported during insertion, and thereafter secured at one or both ends prior to removal of the completed package.

Yet another object of the object of the invention is to provide a packager for manufactured articles which includes a shuttle arrangement for continually advancing individual lengths of a continuous tubular sleeve to an insertion location from a storage location, and tensioning the sleeve while it is positioned for article insertion.

A further object is to provide an apparatus which includes, in combination, an automatically actuated advancing mechanism for an array of manufactured parts, which cooperates in use with a loading head and a sleeve transport shuttle in the formation of individual packages for such array of manufactured parts.

A still further object of the invention is to provide a novel shuttle mechanism which is adapted for reciprocation under control of a transport mechanism, and which includes means for advancing the margin of a packaging sleeve to a positioner unit and retaining the sleeve in an open ended condition for insertion of a group of individual articles while the sleeve is supported from beneath.

Another object of the invention is to provide an apparatus wherein a length of sleeve forming material may be secured with its leading edge margin thereof held open, wherein the sleeve may be tensioned and supported from beneath during insertion of articles in the sleeve, following which end closing flaps may be formed in the package, the sleeve severed from a supply of sleeve material and the package removed from the feed axis while the leading edge of an upstream, succeeding length of sleeve forming material is engaged and prepared for advancement and repetition of the foregoing cycle.

Another object of the invention is to provide a packaging machine wherein a group of articles is fed in a given direction into an open ended sleeve fed from an opposite direction from a continuous length of sleeve material, and wherein a side frame assembly is provided which includes means for transiently supporting the sleeve and for clamping it adjacent its ends when filled, and wherein removal of the package inherently serves to form end portions of the sleeve into flaps which may be formed into package end closures.

A further object of the invention is to provide a packaging apparatus wherein a group of articles may be fed to the interior of a sleeve which is held in a fixed position with one open end, and wherein means are provided for severing the sleeve forming end flaps thereof and removing the package and depositing it on a positioning unit for subsequent movement to a tape applicator, with such movement including transiently positioning the tray for unloading while at the same time removing the clamps from the package ends after they have been formed into closing flaps.

A still further object of the invention is to provide a packaging apparatus having improved means for providing a succession of packaging functions, including sleeve positioning and gripping, sleeve support, end clamping and end flap formation as well as position transfer mechanisms permitting packaging operations to be performed away from the axis along which the articles are fed to the sleeve during the initial stages of package formation.

Another object of the invention is to provide a an improved package sleeve clamping assembly for use in end flap formation.

Yet another object of the invention is to provide an improved packaging apparatus having an improved means for receiving and positioning a free end of a tubular sleeve and retaining it during article insertion.

A still further object of the invention is to provide an apparatus having a novel mechanism for repositioning a being-formed package from a station wherein end flaps are formed on the package to a station wherein closure tape is applied to one or both of the end flaps of the apparatus.

Another object of the invention is to provide a packaging unit which includes a novel apparatus for advancing, wetting and applying a predetermined length of tape to an end portion of a preformed package.

A still further object of the invention is to provide a packaging apparatus wherein novel means are provided for forming individual groups from an ungrouped continuous array of incoming articles, and positioning such groups of articles within staging areas to facilitate transfer of such articles in groups to a desired section of an associated packaging machine.

A further object of the invention is to provide an improved article counter and separator unit for use in packaging an array of identical articles.

Another object of the invention is to provide a novel method of performing individual packaging operations on a group of articles during package formation.

Yet another object of the invention is to provide an article packaging method which includes mechanically inserting a group of substantially identical articles lengthwise into a sleeve section taken from a continuous length of sleeve after positioning and retaining an open end of the sleeve, tensioning it, supporting it from beneath and thereafter removing the package from the insertion area, forming end flaps thereon and removing the finished package from the machine.

The foregoing and other objects and advantages of the invention are achieved in practice by providing a packaging apparatus having means for counting and separating continuous arrays of articles into individual groups, transferring the groups to the insertion area of a packaging machine, advancing a predetermined length of sleeve forming material securing the free end thereof in facing relation to the articles in the insertion area, inserting the articles into the sleeve interior, severing the sleeve while supporting the package from beneath, forming end flap sections thereon and thereafter folding the end flaps while removing the package to a storage area.

The manner in which the foregoing and other objects and advantages are achieved in practice will become more clearly apparent when reference is made to the following detailed description of the preferred embodiment of the invention set forth by way of example and shown in the accompanying drawings, wherein like reference numbers indicate corresponding parts throughout.

BRIEF DESCRIPTION OF THE DRAWINGS

FIG. 2(*a*) is a greatly enlarged side view, partly in elevation and with portions broken away, showing the end support arrangement for a group of articles positioned in the apparatus of FIG. 2;

FIG. 4(*a*) is a side elevational view, partly diagrammatic in nature, and showing further details of the operation of the separator mechanism used to subdivide the articles into groups;

FIGS. 11(*a–d*) are schematic views showing the cross-section of the sleeve material as it moves from a storage position to a package-forming position;

FIG. 15(*a*) is an end elevation view of one of the clamping units used to form the ends of the package taken along lines 15*a*—15*a* of FIG. 15;

FIG. 16(*a*) is an end view of the apparatus of FIG. 16, taken along lines 16*a*—16*a* of FIG. 16;

FIG. 18(*a—f*) are end views, partly diagrammatic in nature, showing the various steps in the removal of the being formed package from its support position to the tape application position;

DESCRIPTION OF THE PREFERRED EMBODIMENTS OF THE INVENTION

Figure 1:
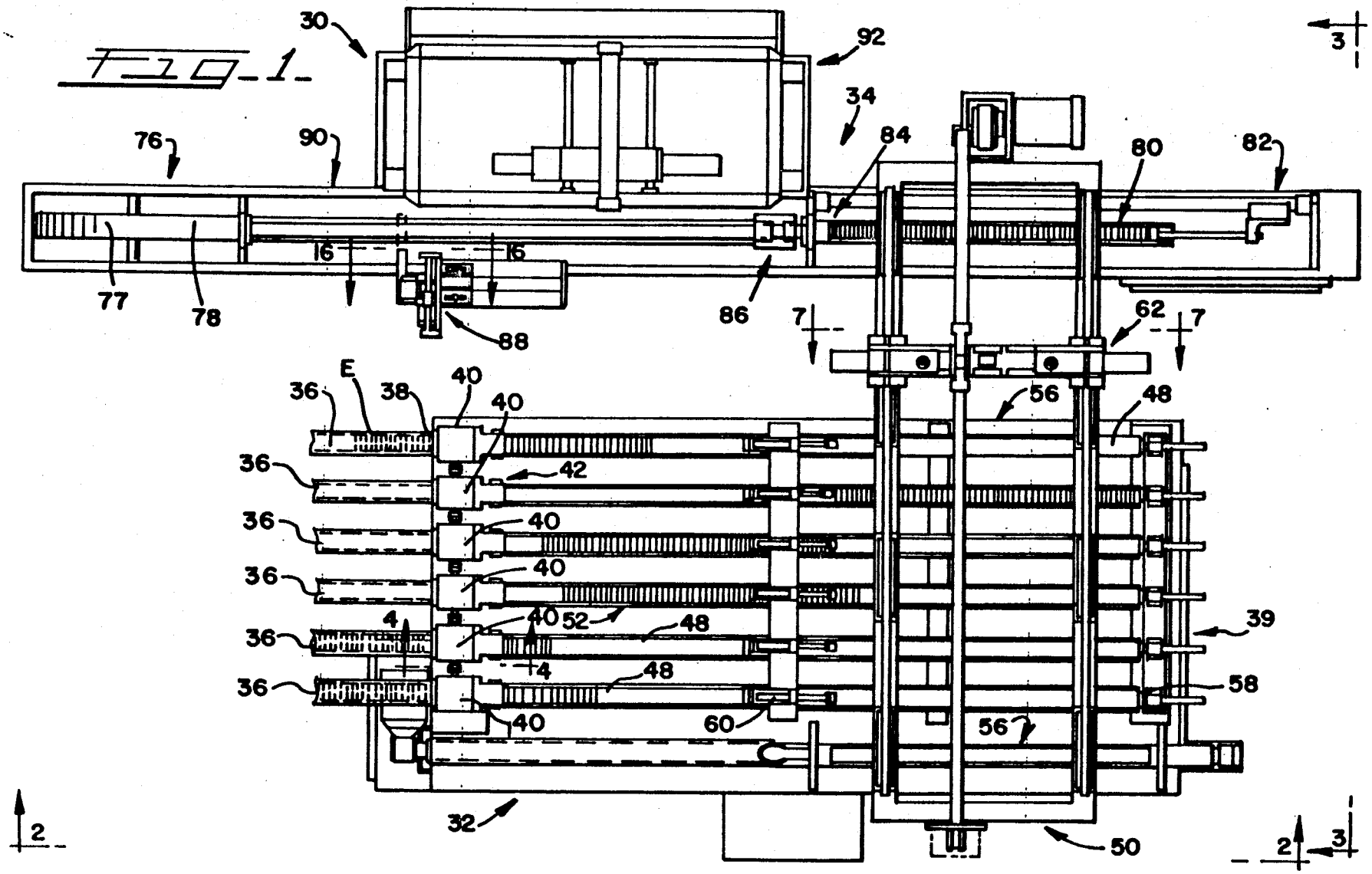
FIG. 1 is a top plan view of the packaging apparatus of the invention, showing the counter/separator unit receiving a plurality of can ends, counting them and separating them into individual groups, the manner of transferring such groups to an associated packager unit, and the layout and principal elements of the packager.

While the end packaging unit of the invention may be embodied in different forms and may include different accessories or auxiliary features, and while the invention may be practiced when utilizing less than all of the capabilities of the machine, and while the machine is likewise capable of packaging groups of articles other than can ends, a detailed description will be given of a form of machine having two major components, a counter/separator unit and a packager unit. As described in detail, the product being packaged is a stack of can ends, usually about four hundred ends, more or less; the packaging material is a gusseted and folded flat reel of untreated kraft paper capable of being readily expanded into a tubular sleeve, and wherein the end closing method includes taping one or both folded ends of the package or merely folding both ends of the package to retain the can ends therein.

Before describing the construction and operation of the apparatus of the invention in detail, it is believed helpful to outline generally the various functions which are to be performed by the elements of the automatic end packager of the invention and the operations performed by auxiliary or associated equipment which groups, counts and stages the ends or other articles for transfer to the packager per se.

Therefore, viewed from a functional standpoint, the first stages of the operation consist of receiving ends in a series of continuous arrays, each following a path determined by its own guideways, and feeding ends from each of inbound lane past what is termed an integrated mover. Before this stage, the ends are properly aligned, but are in a plurality of individual, continuous arrays. As the ends pass through the integrated mover, they are counted by the sensor element of a counter probe which counts each individual end. When a predetermined number of ends has been counted, a group is formed in a group-forming area by a so- called pre-splitter blade and a pair of movable jaws.

The jaws form a transient barrier between the trailing face of the last end in the group being formed and the leading face of the following end. The group of ends thus previously counted is separated by pushing it as a unit at an accelerated rate toward a staging area, where the group comes to rest in the staging area of its particular inbound lane.

Hence, from time to time, the continuous arrays of ends are subdivided into individual groups, each having a precisely determined number of ends, and these groups are staged for transfer to the packaging unit. Thereafter, a pick-up head is used to index over the staging area of an appropriate inbound lane, and pick up a stick of ends for transfer to the loading track of the packaging unit.

Preferably, the count of ends in each stick having been made and stored in a memory, the count may be transferred to an auxiliary unit such as a printer, whereby, in time, the exact number of ends contained in that particular stick may be imprinted on the exterior of the package for subsequent reference by the user.

Referring now to packaging, the packager itself includes a number of stations, certain of which are involved in providing a supply of packaging material, and others of which perform other functions, including package forming, package support filling, and end flap formation, folding and taping. In use, a selected length of kraft paper is advanced by a shuttle mechanism to a loading station. The leading edge margin of the sleeve is gripped as the shuttle returns to its starting position. Then the sleeve is tensioned, supported from beneath, and the group of articles is inserted.

Next, the sleeve is clamped near its ends and cut to form a new end. The package is then removed to an area in which the package end flaps are formed and folded. Finally, the ends of the package is lowered to another position whereat tape is applied to one or both ends, and the completed package is removed to a buffer bin or storage area.

The machine of the invention may optionally include a non-contact printer unit, such as an ink-jet printer, to imprint various data on the package, including source data, the actual end count and other information desired by the user for one reason or another.

The exact manner in which the apparatus functions is described in detail herein, but as pointed out above, the apparatus is best envisioned as a pair of cooperating machines, one serving to count the articles, form them into groups and stage a plurality of these groups for transfer, and the other being the packaging machine which receives and positions individual groups of ends on a single infeed track and inserts them into a being-formed package. The packager subdivides a continuous length of sleeve into individual package-forming lengths which are filled with articles, with end-forming flaps being folded into a closed position at the package ends.

Figure 2:
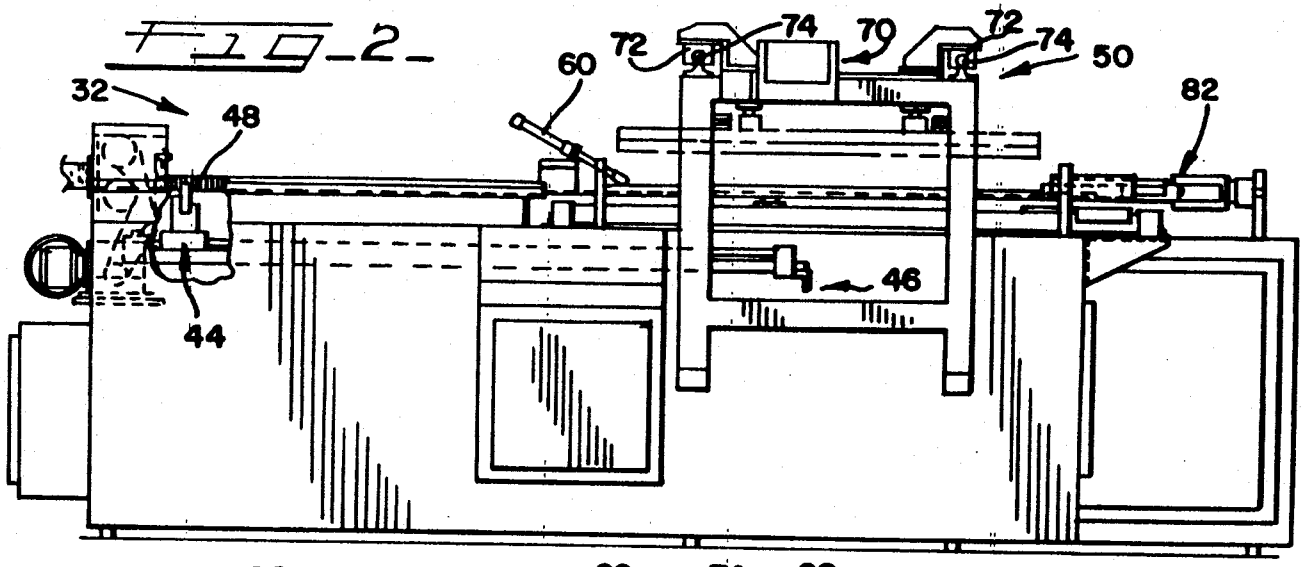
FIG. 2 is a side elevational view, with portions in section, showing the counter/separator unit of FIG. 1.
Figure 2A:
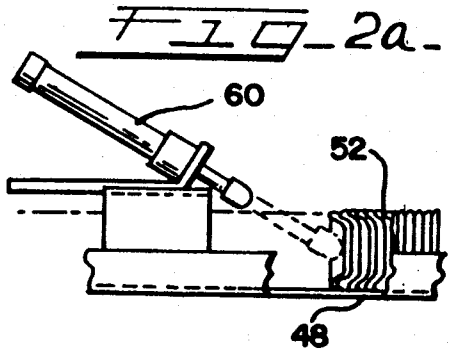
Figure 3:
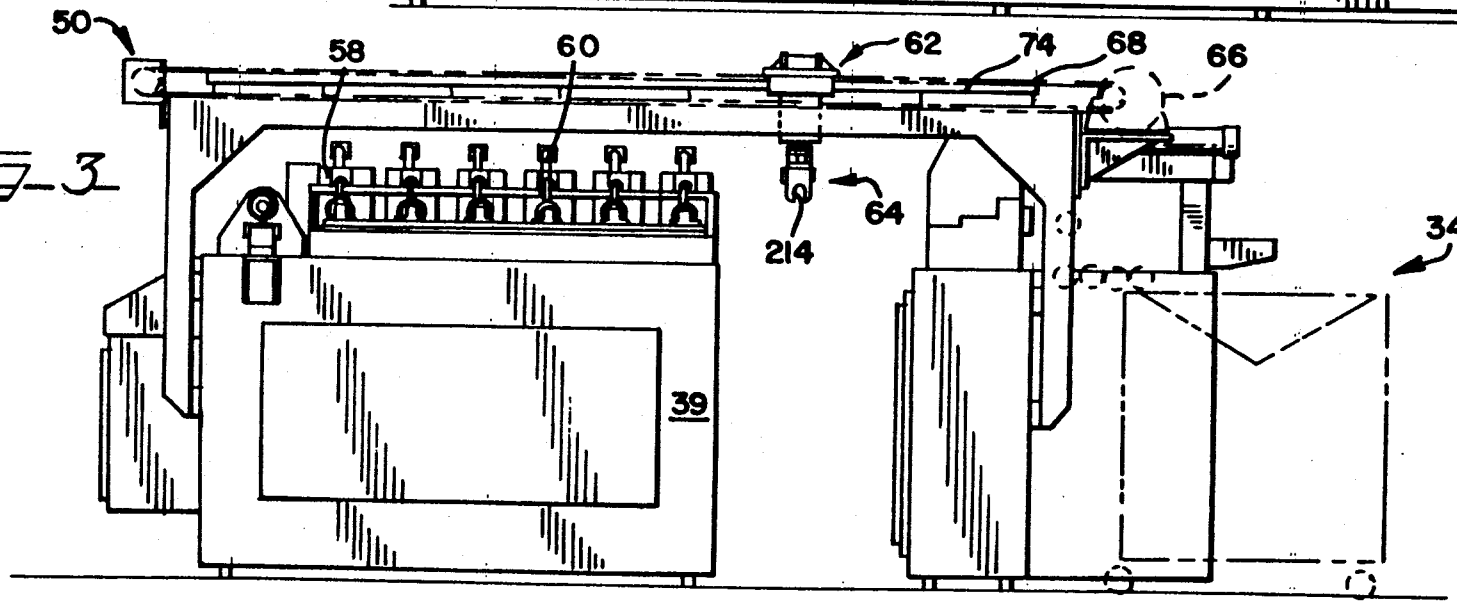
FIG. 3 is a end elevational view, taken along lines 3—3 of FIG. 1 and showing the pick-up head for transferring individual groups of articles from the inbound lane staging areas of the counter/separator to the group insertion station of the packager unit.

Referring now to the drawings in greater detail, FIGS. 1-3 show a combination article grouping and packaging unit generally designated 30 and shown to include two principal components, a counter/separator unit generally designated 32 and used to count individual can ends and subdivide them into groups in which they are staged for transfer to a second or article packager unit, which is generally designated 34. Both the counter/ separator unit 32 and the article packager unit 34 include a number of principal individual components, which will first be identified and then later described in detail.

Figure 4:
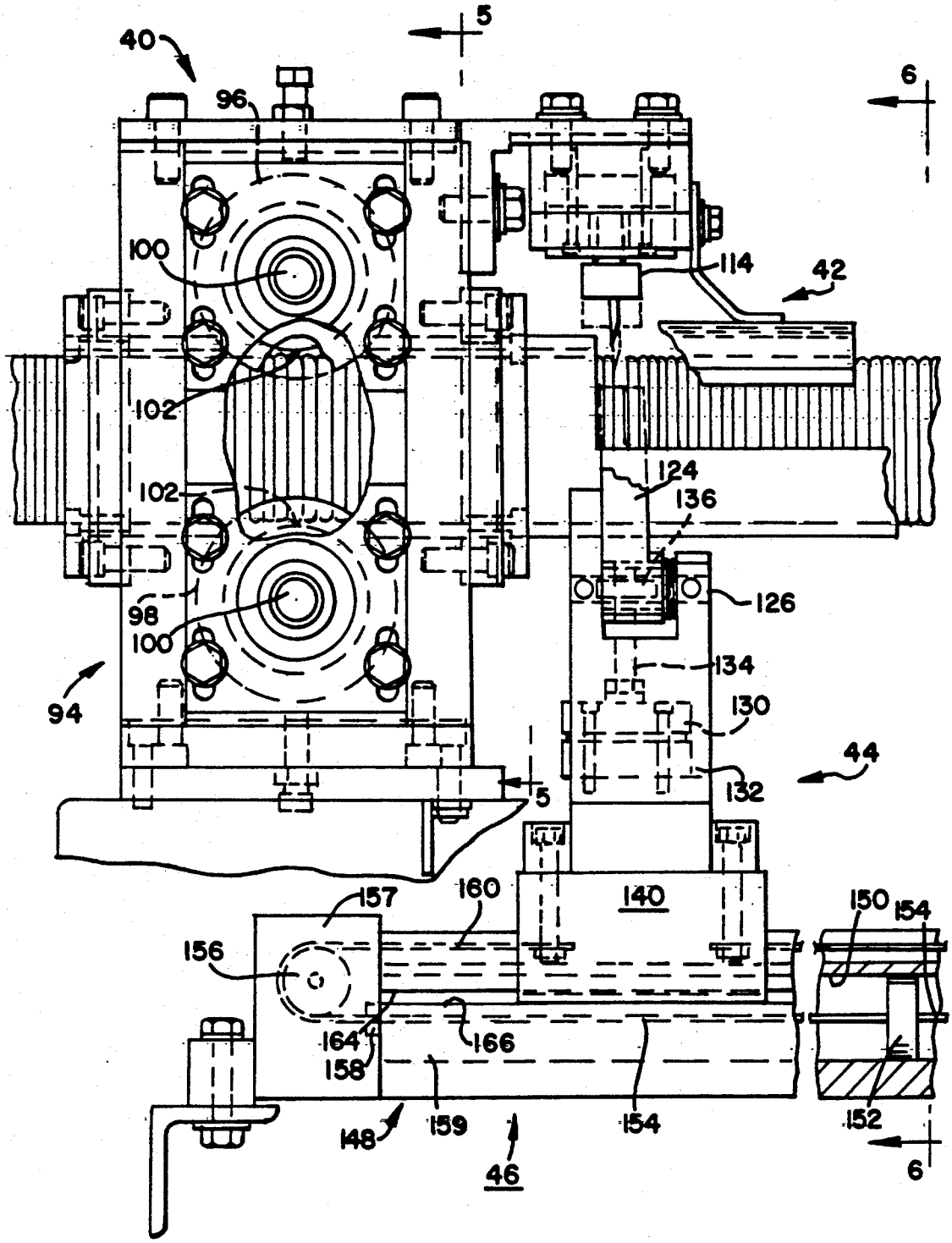
FIG. 4 is an enlarged side elevational view of a part of the counter/separator, with portions broken away, and with other portions in section, showing parts of the integrated mover unit, certain elements of the counter mechanism and the separator mechanism used to subdivide the continuous array of incoming articles into individual groups.
Figures 4A, 5, 6:
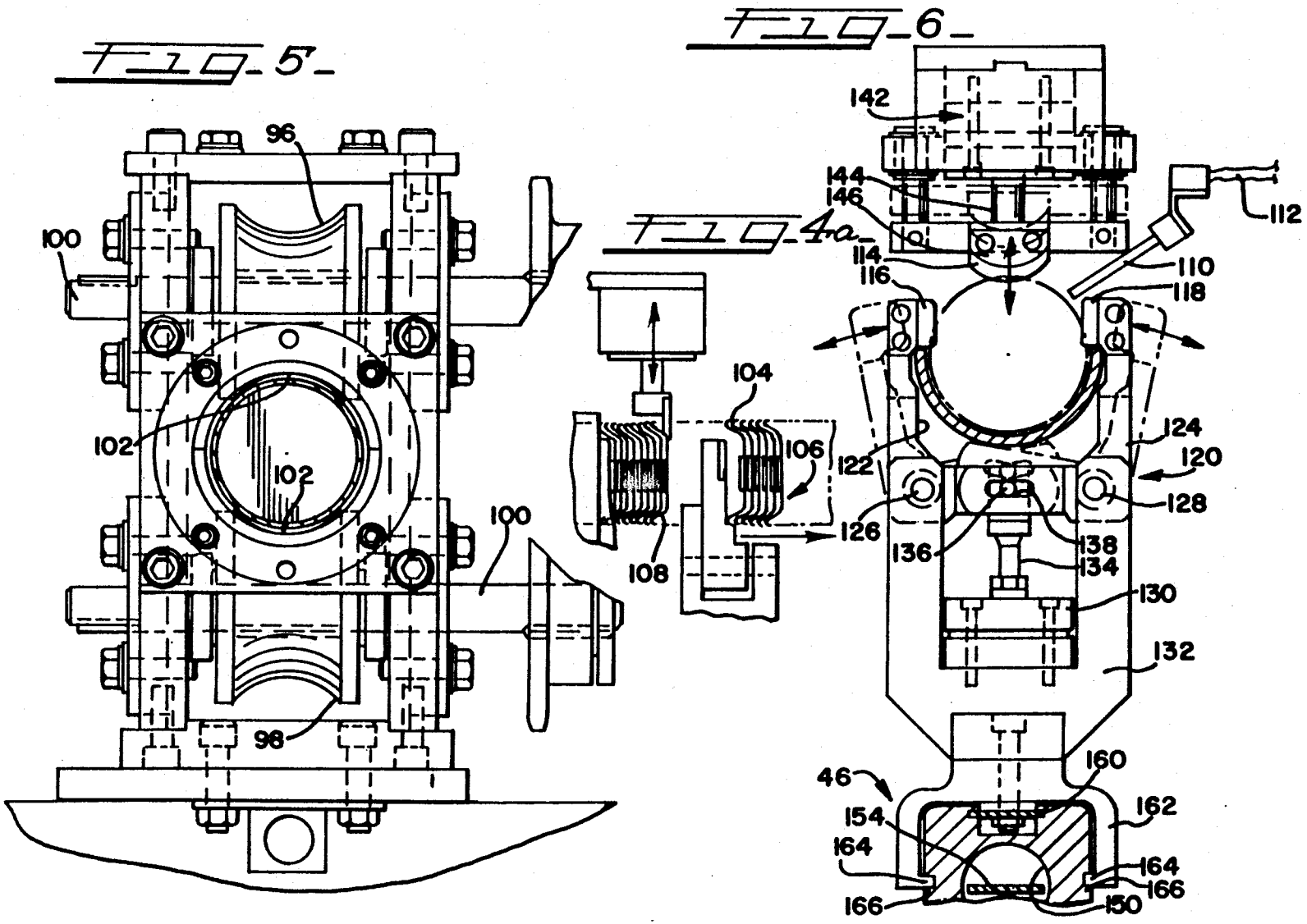
FIG. 5 is a vertical sectional view of the integrated mover unit of FIG. 4, taken along lines 5—5 thereof.
FIG. 6 is a vertical sectional view of the mover unit of FIG. 4, taken along lines 6—6 thereof and showing other details of the end counter and of the separator mechanism used to form the incoming articles into individual groups.

Referring now to the principal components of the counter/separator 32, these include a plurality of guiding means in the form of guide rails or tubes 36 for directing a plurality of inbound units (in this case, can ends "E") which are inbound in nested, face-to-face relation. Adjacent the innermost or downstream ends 38 of the guide units 36 are a plurality of so called integrated mover units 40, details of which are shown in FIGS. 4–6(*a*). The foregoing and other elements are mounted on a counter/separator machine frame generally designated 39.

As is shown in FIGS. 1 and 2, the counter/separator 32 includes a plurality of group forming assemblies each generally designated 42, plural group transport assemblies generally designated 44, and plural transport actuator assemblies generally designated 46. Since the articles being feed are can ends, the guide or lane-forming means in the counter/separator 32 are in the form of semi-circular channels 48 disposed parallel to one another; each forms a lane dedicated to receiving products from an associated, inbound guide unit 36. The channels 48 extend to and terminate beneath a machine cross frame generally designated 50 below which plural groups, generally designated 52, of individual articles generally designated 54, are arrayed prior to being transferred to the packager unit 34.

The areas beneath the cross frame 50 may be referred to from a functional standpoint as group staging areas 56, and these areas are defined by fixed stop units 58 for the leading article in the group 52 and movable stop units, generally designated 60, for the trailing article in the group 52. The fixed stop units normally have associated therewith a detector (not shown) such as a light beam and photoelectric cell arrangement to indicate that a group 52 is in the channel 48. The movable stop unit is shown in detail in FIG. 2(*a*). As will appear, an exactly counted number of articles may be supported and maintained in a group by being held between the fixed and movable stops 58, 60.

Another major component of the article processing apparatus 30 of the invention is the group transfer mechanism, generally designated 62 and shown to include the cross frame 50, which serves to mount a pick-up head generally designated 64 and an associated pick-up head drive motor 66. The motor 66, and its associated control and gear drive, actuates a drive belt 68, preferably of the toothed or "Gilmer" type which accurately indexes the pick-up head frame 70 over a desired channel or lane 48 in the staging area 56. Two longitudinal guide rods 74 have bushings 72 with eyes which align the pick-up head assembly 64 and position it for reciprocable movement in use. Additional construction and operational details of the pick-up head mechanism and related component are shown in detail in FIG. 7 and are described in detail in reference thereto.

Referring again to FIG. 1, various principal components of the packager unit 34 are shown These include a supply reel generally designated 77 for a continuous length of pre-formed wrapping sleeve material 78, an article group receiving area generally designated 80 and aligned with a reciprocable group insertion unit generally designated 82, a sleeve end positioner generally designated 84, and a shuttle assembly generally designated 86. All of these elements are described in greater or less detail elsewhere herein. FIG. 1 also shows other elements, including an adjustably positionable sleeve cutter assembly 88, fixed to one side of the longitudinal main frame 90 of the packager 34, and that a side frame 92 is positioned on the other side of the main frame 90. As will appear in connection with a description of FIGS. 14, 15, 15(*a*) and 17, for example, the side frame houses a plurality of other individual units which perform important operations in the packaging cycle, including provision of the means for clamping, end flap forming and folding, and taping the package made by the apparatus, as well as moving the package during various stages of its filling and formation.

Referring again to FIG. 1, various overall aspects of the packager unit 34 of the invention are shown in their relation to the mechanism as a whole. As shown in FIG. 1, the packager 34 includes a storage area generally designated 76 for receiving a roll of folded sleeve material generally designated 78.

Referring now to generally to FIGS. 4–6, details of the integrated mover unit generally designated 40 and its associated components are illustrated. These elements include a roller housing generally designated 94, which, with suitable conventional bearings and the like positions a pair of vertically spaced, upper and lower hourglass rollers 96, 98, which are preferably made from an elastomeric material.

Each roller is operated by an associated drive shaft 100, and all of the rollers are operated synchronously by a drive mechanism (not shown) intended to operate the rollers at identical peripheral speeds. Each roller 96, 98 includes an opposed working surface 102 adapted to engage and grip the edge portion 104 of a can end here generally designated 106.

As will be noted in FIG. 4(*a*), each of the ends 106 has a countersink wall 108 which permits nesting of the ends as a whole. This wall 108 and the curl forming the top of the end are gripped by the working surfaces 102, thereby aligning the ends vertically. In this connection, it will be noted that the ends nest relative to one another, and hence do not readily fall forward or backward from the group; therefore, assuming that the ends are kept relatively close together axially, they tend to remain grouped rather than falling free at the group ends. It will be further noted that the various pushers for the groups of ends, and the weight of ends upstream vertically of any particular point in a group of ends, exert an axial compressive force on the ends.

The ends are relatively compressible in groups, demonstrating for example, two to five percent compressibility upon the application of moderate forces. This compressibility is accounted for by the deflectability of the tabs or the inherent resilience of the countersink wall, or both. Hence, accurately determining the exact number of ends in a group cannot be done reliably by measuring length as was sometimes heretofore done, but requires counting each individual end.

In this connection, and referring to FIGS. 4–6, group forming assemblies 42, the transport assemblies 44 and the transport actuators 46 are shown, as are the counter probe unit 110 and its associated electrical connectors 112. This counter unit operates on principles known to those skilled in the art, and is preferably a reflective beam - threshold intensity probe unit which emits a light and determines the existence and intensity of light beam reflection. As articles passing by become more and then less proximate, the peaks of reflective intensity are detected and each such peak creates a pulse in associated counting equipment. Such count is retained in memory for association with the package in question. The actual operation of such mechanism is not a feature of the invention which is novel per se, but one advantage of the invention is the ability to utilize counting equipment of this sort for highly accurate article counting and processing.

Referring again to the group forming assembly 42, each of these plural identical units is shown to include means in the form of vertically reciprocable blade 114 adapted to engage a leading edge of the ungrouped array of ends to transiently prevent advancement of the remainder of the group. This blade 114 and its associated elements cooperate with means in the form of an opposed pair of knife edges or surface-engaging blades 116, 118, arranged on a scissor mechanism generally designated 120. When the counter unit has reached a pre-determined count, the blade 114 moves vertically in response to a count signal, and thus begins the process of dividing the ungrouped array into a leading and a trailing group. Immediately thereafter, the blades 116, 118 move inwardly to engage the trailing edge of the last article in the group lying downstream of the blade 114. The immediately successive operations of the vertical blade 114 and the horizontally movable blades 116, 118 ensures that the division between leading and trailing articles is made cleanly, and that both sides of a single article are engaged rather than sides of adjacently disposed articles which might create tilting and misfeed.

Referring now to the scissor mechanism 120, this will be seen to include left and right hand bell crank arms 122, 124, which are mounted on pivot pins 126, 128. An air cylinder 130 positioned by a yoke 132 and containing an operating rod 134 is able to move a clevis pin 136 through a short vertical range of movement. This pin 136 is disposed in slots 138, in the inner margins of the crank arms 122, 124. Consequently, upon a signal generated by the counter, the pneumatic cylinder may be actuated, and the blades rapidly move radially inwardly and engage the trailing surfaces of the trailing article to form an article group. As shown in FIG. 4, the yoke 132 is in turn positioned on a carrier element 140 forming a part of the transport mechanism described herein.

Referring again to FIG. 4, will be noted that the upper "pre-splitter" or vertically reciprocating blade 114 is also operated by a pneumatic cylinder generally designated 142 and containing an operating rod 144 which terminates at its lower edge in a holder 146 for the blade 114.

Referring now in particularly to FIG. 4, the operation of the transport actuator 46 will be described. In this connection, will be understood that the actuator 46 is only one of a group of substantially identical actuators used to operate various mechanisms of the invention. The actuators of the type presently preferred for use in the present invention are of a type known as "Tol-o-matic" cylinders which are made by the Tol-o-matic Company of Minneapolis, Minnesota and whose operation is known to those skilled in the art. The following general description therefore is made for ease of understanding and is primarily schematic.

Referring now to the lower part of FIG. 4, will be seen at the actuator assembly 46 includes a housing generally designated 148, having an interior cylindrical side wall 150 which positions a reciprocating piston 152 having one end of a continuous metal tape 154 attached to each of its end faces. The tape 154 is trained over a rotary, fixed axis guide roller 156 positioned in an end cap 157 for the cylinder.

The actuator 46 also includes a seal 158 for retaining air within the interior 159 of the cylinder 150. The other ends 160 of the tape 154 are affixed to either end of the carrier 140. The carrier includes a cover unit 162 having guide ears 164 received in longitudinally extending guide slots 166 on the exterior of the unit 46. Consequently, in operation, when either end of the cylinder is pressurized, the piston will move in the opposite direction, moving the tape over the roller and causing the carrier unit to move atop the housing in the opposite direction. A series of Commercial units normally include a series of protective covers or casings for the tape and appropriate keyways or like arrangements generally shown in FIG. 6 are usually provided for this purpose.

Figures 7, 8:
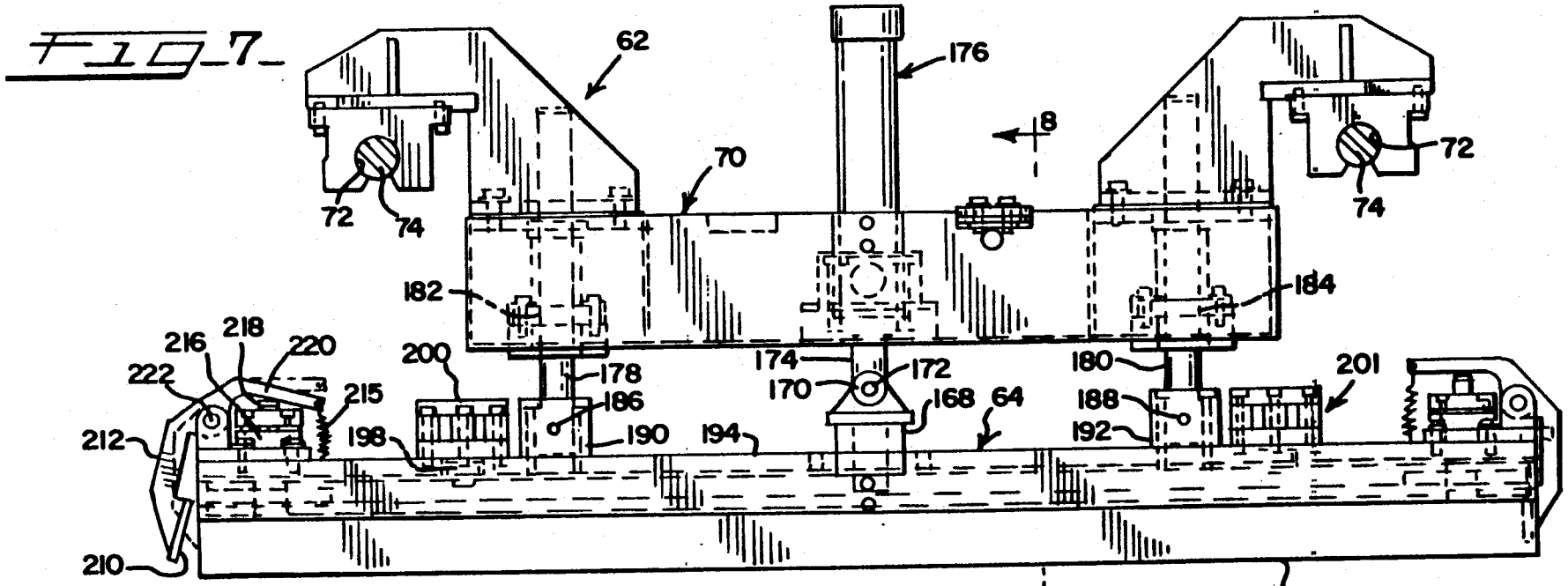
FIG. 7 is a end elevational view of the article group transfer unit of the apparatus, including the pick-up head.
FIG. 8 is a vertical sectional view of the pick-up head and head positioner of FIG. 7, taken along lines 8—8 thereof.

Referring now to FIGS. 7 and 8, various construction and operational details of the pick-up head 64 of the invention are shown. The pick-up head 64 is of a generally known type, such as that referred to for example in U.S. application Ser. No. 906,063, filed Sept. 11, 1986, now in U.S. Pat. No. 4,808,057. However, this head has been modified somewhat for the purpose of the present invention and is therefore shown in detail here.

Basically, the head 64 includes a pick-up head frame 70, means for moving the head transversely over the lanes 48 in which the incoming articles are received, and means for moving the head vertically, means for removing the ends or other articles once gripped, and means for securing the ends against falling from the end of the assembly unit 64.

FIG. 7 shows not only the pick-up head frame generally designated 70, but the arrangement of the movement and guide systems. Thus, the head 64 includes a mounting bracket 168 having an eye 170 therein for receiving a mounting pin 172. The pin is disposed in a lower portion of a operating rod 174 extending from the lower end of a piston and cylinder assembly generally designated 176. According to the invention, the double acting piston and cylinder assembly 176 causes vertical reciprocation of the bracket 168 and the head 64 carried thereby.

In order to insure appropriate vertical movement in an aligned relation, left and right hand identical guide rods 178, 180 are received in suitable bearings 182, 184 provided in the frame. The lower ends of the guide rods 178, 180 are pinned, as at 186, 188 to two stub mountings 190, 192 on the top frame 194 of the pick-up head.

Referring to FIGS. 7–8, it will be noted that on the interior of the head assembly 64 there is disposed a longitudinally extending, inverted V-shaped channel unit 196, which is secured to an associated knock-out cylinder 200 at plural, spaced apart points by a rod 198. Actuation of the cylinder 200 moves the support rod 198 vertically, pushing the ends or other articles thereon downwardly relative to the frame 194. As is shown in FIG. 8, articles such as the ends generally designated E are retained in place by the radially slightly inwardly directed lower margins 202, 204 of sidewalls 206, 208 of the pick-up head.

In the preferred form of unit, these sidewalls 208 are made from a plastic material, such as LEXAN® polycarbonate plastic material having a strong elastic memory. In use, the sidewalls 206, 208 deflect slightly outwardly when the head is received over a fixed column or group of ends or other articles, and are thus simply press fit into the article receiving area in the pick-up head.

The innate resiliency of the sidewalls is sufficient to confine the articles until they are forcibly removed by actuation of the cylinder 200 and the rod 198. One cylinder piston and rod assembly 200, 198 is described in detail; its counterpart generally designated 201 in FIG. 7 will be understood to be identical and is therefore not described in detail herein.

Referring again to FIG. 7, there is shown a pair of substantially identical, left and right hand end clip assemblies. Each of these is intended to position an apertured end plate 210 by means of an arm 212 to retain ends within the pick-up head 64. The end plate 210 preferably includes a semi-circular recess 214 (FIG. 3) permitting it to fit over the end of the fixed and movable stops 58 and 60 (FIG. 1).

FIG. 7 shows the left hand mechanism in the open position, toward which position it is schematically shown to be biased by a spring 215. Upon generation of a proper signal, the control cylinder 216 is actuated pneumatically, urging the operating rod 218 vertically until it engages the lower surface of the pivot arm 220. Further movement causes of the arm 212 and the end plate 210 about the axis of the pivot pin 222, thus positively retaining the ends E within the pick-up head 64. FIG. 8 also shows that clamps 224, 226 are used to secure the free ends of the drive belt 68 to the movable frame 70.

Hence, it is apparent that in operation, when it is desired to position the frame 70 such that the head 64 is aligned with a given lane 48, the control (not shown) is actuated and the drive motor 66 moves the belt 68, stopping the unit just above the desired inbound lane in the staging area. A D.C. motor drive of a known type is suitable for this purpose.

Thereupon, the cylinder 176 is actuated and the head is lowered fully until the ends are gripped between the sidewalls 206, 208 of the head 64. This is done with the end clamps in the open or extended position. The ends are then end clamp cylinders are then operated in the end camps retain the respective ends of the group. The cylinder 176 is then actuated, raising the head. The motor pulls the belt until the head is positioned over the loading or group receiving area 80 of the packer unit 34. Then, the sequence of operation is reversed.

When the head is lowered by the cylinder 176, it is held in the position spaced just apart from the loading area, and the unloading or discharge cylinder and rod apparatus 198, 200 are energized, this removes the ends from the pick-up head and deposits them as a group in the loading area. Next, the pick-up head 64 is moved by the frame 70 to the next succeeding position and the cycle is repeated.

As pointed out, the machine, using the counter memory, and being appropriately programmed for an operating sequence as will be described, is able to determine the particular of lane from which an article group is to be picked up, and also recalls the appropriate count for each group.

Figures 9, 10:
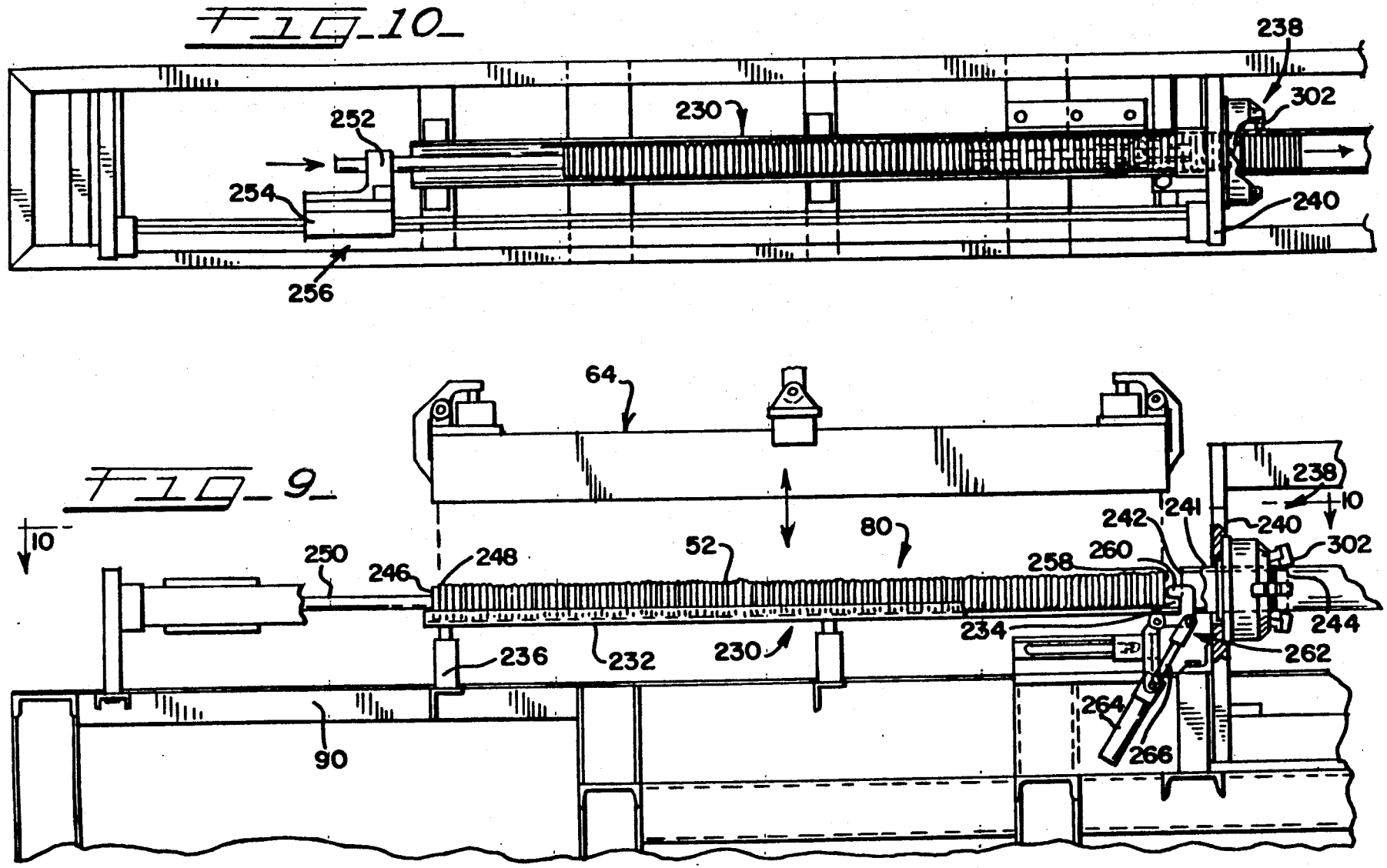
FIG. 9 is a side elevational view of the article group receiving portion of the packager unit of the invention, showing the pick-up head and portions of the group insertion mechanism.
FIG. 10 is a top plan view of the group receiving station shown in FIG. 9 and taken along lines 10—10 thereof.

Referring now to FIGS. 9 and 10, certain aspects of the article group positioning and inserting mechanism generally designated 230, and located in the article group receiving area 80, are shown. As illustrated, the article group receiving and inserting mechanism 230 includes several principal elements, including means in the form of a semi-circular channel 232 for receiving and positioning a group of articles arrayed in end-to-end relation. The channel 232 is supported by a plurality of spaced apart stands 236 extending up from the longitudinal machine frame 90 and is open at its downstream end 234.

Here, the channel 232 joins the article insertion guide assembly generally designated 238 and shown to be mounted on a transverse bulkhead 240. The guide assembly 238 includes a guide tube 241 having inlet and outlet ends 242, 244 (best seen in FIG. 11.)

Referring now to the manner of feeding groups of articles through the guide assembly 238, FIGS. 9 and 10 show the article group 52 positioned on the channel 232, with the pick-up head unit 64 disposed thereabove. In use, the center lines of the channel 232 and the pick-up head 64 respectively are aligned so that the articles may be simply dropped into the channel 232.

In the article group receiving area 80 is an insertion unit generally designated 82 and shown to include a plunger 246 affixed to the end of an operating rod 250 and adapted to engage what becomes the trailing end article 248 of the group of articles 52 through the guide 238 and into a packaging sleeve in a manner to be described. The operating rod 250 is positioned by an arm 252 (FIG. 10) which is secured to a reciprocable carrier unit 254. The carrier 254 forms the exterior reciprocable element of a "Tol-o-matic" or like actuator assembly generally designated 256 which is essentially identical in construction and operation to those actuators described in connection with FIG. 4 hereof.

Referring now in particular to FIG. 9, means for positioning what becomes the leading end article 258 in the array 52 is provided in the form of an article end support finger 260 forming a part of a link assembly generally designated 262 for transiently retaining the leading end article 258. An end support piston and cylinder assembly 264 includes an operating rod 266 positioned, such that, upon reciprocation, the finger 260 will be raised into contact with a leading edge surface of the end article 258. As the pusher rod 250 is moved by the carrier 256 to the right as shown in FIGS. 9 and 10, the finger 260 is pushed out of the way against light resistance. This permits the group of articles to move to the right.

In use, a principal function of the end support finger and the associated apparatus is that, once the group of articles has been deposited by the pick-up head, it may be desired to pre-load or very slightly compress the stack of articles by applying a downstream axial force to the operating rod 250. The finger not only prevents the end article from tilting or falling forward, but also ensures that the slight axial compressive load may be applied to the article group 52 as a whole without undesirably moving it until such action is indicated by the sequencing controls. Thereafter, as additional moving force is applied to the operating rod, the finger may be either pushed aside or positively withdrawn by the action of the piston and cylinder assembly 264.

Figure 11:
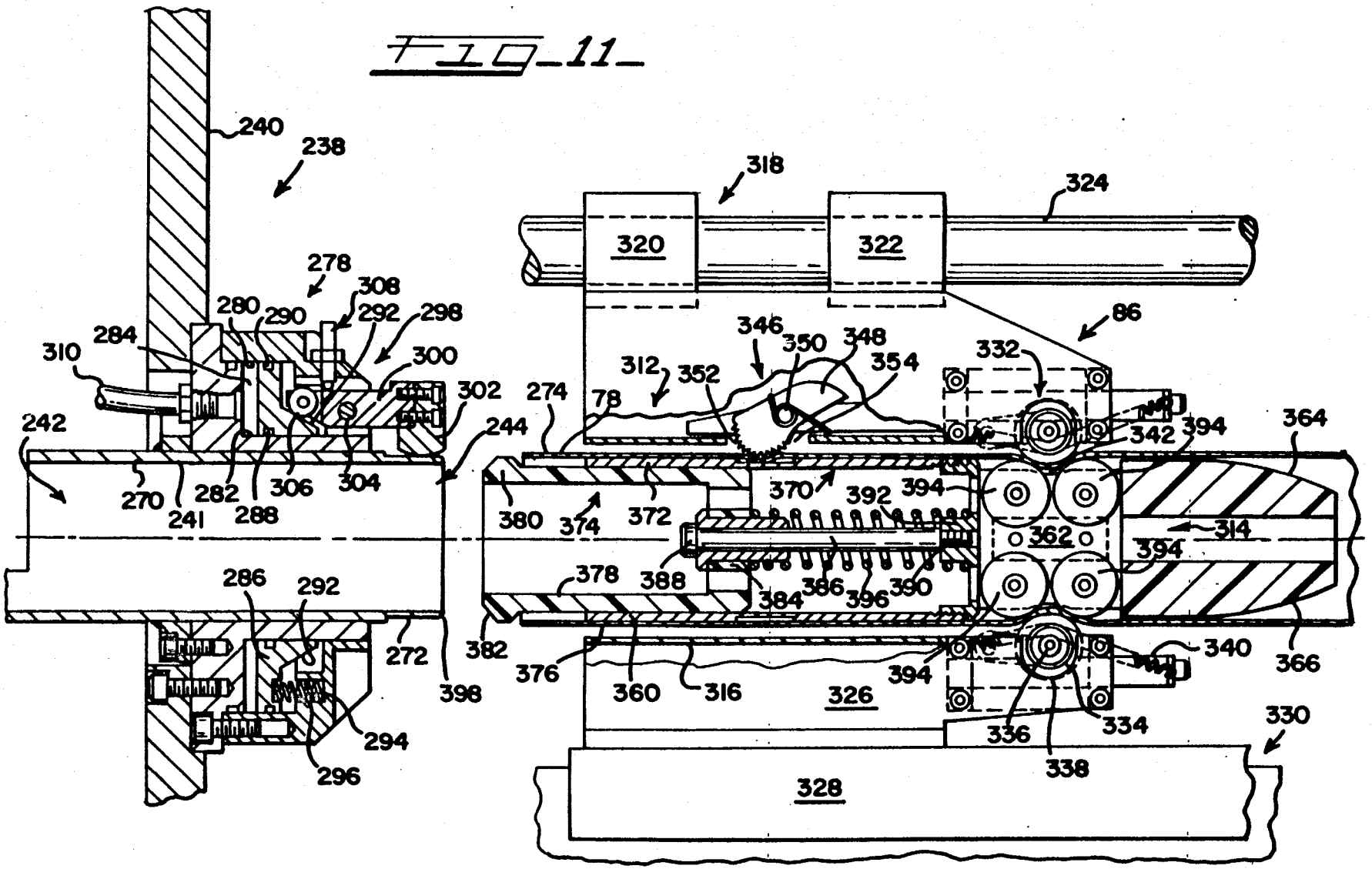
FIG. 11 is a greatly enlarged vertical sectional view of the insertion guide assembly and principal elements of the shuttle assembly used to feed the packaging sleeve material to the sleeve positioning and gripping mechanism of the invention.
Figures 11A, 11B, 11C, 11D, 12, 13:
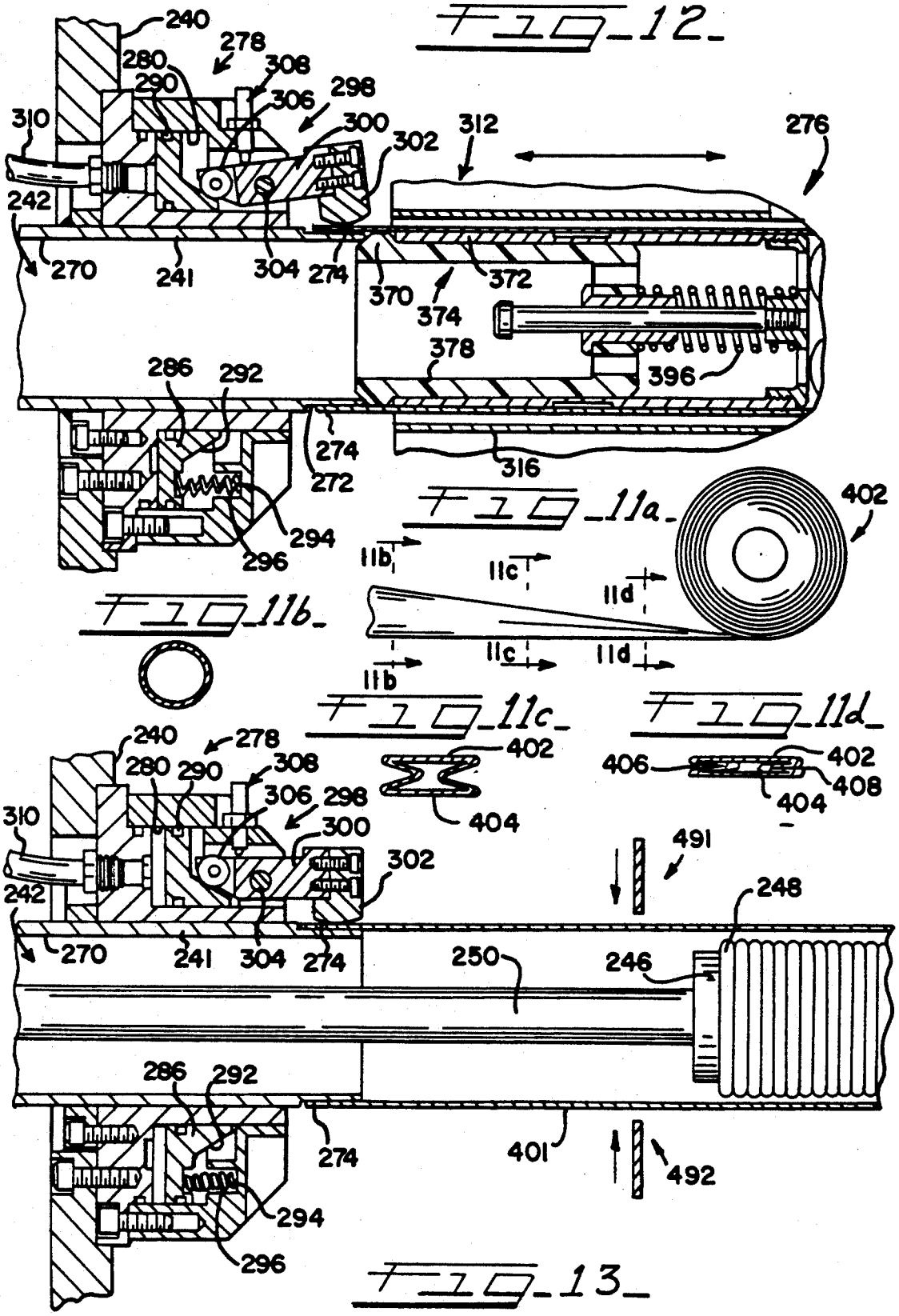
FIG. 12 is a vertical sectional view similar to that of FIG. 11, showing a subsequent step in the sleeve advancing and positioning operation carried out by the shuttle assembly and the sleeve positioning mechanism.
FIG. 13 is a view similar to that of FIG. 12, showing the last phase of the article insertion step.

Referring now in detail to FIGS. 11–13, additional details of the article group insertion guide assembly 238 as well as the sleeve end positioner 84 and the shuttle mechanism 86 for advancing, positioning and retaining the sleeve 78 of package forming material are shown.

Referring first to the guide assembly 238, it will be noted that this unit is supported on a machine bulkhead 240 and includes a cylindrical tube 241 having inlet and outlet end portions 242, 244. The guide tube includes an inside diameter surface 270 which is sized just larger than the outside diameter of the articles 54 being inserted therethrough; the sleeve end positioner 84 of the tube 241 comprises a reduced diameter cylindrical outlet end margin 272 and other elements to receive and retain the leading end margin 274 of the sleeve material 78 being advanced by the shuttle assembly 86.

Because the article group and the sleeve material are fed in opposite directions, the term "downstream", while accurately applied to both operations, denotes a different direction for each operation. In FIGS. 9 and 10, for example movement to the right is downstream for the articles and upstream relative to the sleeve material.

As is shown in FIG. 11, the guide unit 238 includes a pneumatic housing generally designated 278 and opposed, radially inwardly and outwardly directed cylindrical surfaces 280, 282 which define therebetween an annular, pressurizable chamber 284 positioning an annular piston 286 for reciprocation. The piston 286 includes inside and outside diameter O-ring or similar seals 288, 290, and further includes a plurality of inclined cam or ramp surfaces 292. The housing 278 includes a plurality of circumferentially spaced pockets 294 for receiving return springs 296 which act on an end face of the annular piston 286 to return the same to a withdrawn position.

The sleeve end positioner 84 also includes means for gripping a leading edge margin of the sleeve material 78. The positioner arrangement includes a plurality of assemblies generally designated 298 and each shown to include a rigid finger 300 having affixed thereto a sleeve end gripping pad 302. Each finger moves about a pivot pin 304 in response to radial movement of the roller assembly 306. An associated spring plunger unit 308 biases the roller end of the finger 300 inward and thus raises the gripping pad 302; this is permitted only when the chamber 284 is evacuated and the return springs 298 extend and withdraw the piston 286. When the chamber 284 is pressurized by a charge of compressed air entering through the hose and fitting 310, the rollers 306 ride up the ramp surfaces 292 and push the finger pads 302 into snug contact with the end margin 274 of the sleeve 78. Releasing pressure permits the piston to return as explained above.

Referring again to FIG. 11, and now to what may be termed the sleeve advancing and positioning shuttle assembly generally designated 86, this assembly is shown to include two principal elements, an outer cylinder assembly generally designated 312 and an inner mandrel assembly generally designated 314. The outer cylinder assembly 312 in turn includes a cylindrical metal sleeve 316 of circular cross section, and a cylinder guide unit generally designated 318 and shown to include a pair of spaced apart, aligned bushings 320, 322 whose inside cylindrical surfaces engage a guide rod 324. On the lower side of the cylinder 316 is a flange 326 affixed to the actuator 328 of a "Tol-o-matic" positioner unit generally designated 330. In addition, the outer cylinder unit includes two or more centering roller assemblies generally designated 332 which cooperate with their counterparts on the mandrel 314. These units 332 include centering rollers 334 positioned on axles 336 and urged by an axle carrier 338 into a radially inward position. Tension springs 340 exert a radial outward force on the axles 336; however, the clip unit releasably engages and normally positions the rollers in the radially inner position shown. Here, the rollers nest with and lie between an opposed pair of mandrel rollers 394. As is shown, the flexible sleeve of kraft paper material 78 is trained radially inside the cylinder roller and radially outwardly over the mandrel rollers; the rollers and the slight working clearance permit relative movement of the sleeve when the mandrel and cylinder retract, as is described elsewhere herein.

The other principal element of the cylinder assembly 312 is the ratchet feed assembly generally designated 346. The feed assembly 346 includes a plurality of identical claw assemblies 348 mounted for pivotal movement about a stub shaft 350 so that the saw toothed end surfaces 352 may move into and out of a slot 354 on the cylinder body. When in use, the toothed surface 352 of the claw 348 moves into a position of engagement with the kraft paper sleeve 78 when the shuttle unit 86 is moving to the left or feed position as shown in FIG. 11; when the shuttle assembly 86 is withdrawn or retreats, the claws 348 are cammed out of the way by a rail (not shown) permitting the outer cylinder 316 to slide smoothly over the exterior surface of the paper sleeve 78.

Referring again to FIG. 11, details of the mandrel assembly 314 are shown. This unit 314 includes a forward body generally designated 360, a center body 362 and a rear body 364. The rear body 364 includes a modified conical tapered surface 366 designed to permit easy return of the mandrel through the inner surface of the sleeve 78. The center body portion 362 is provided to position and support the mandrel rollers 394. The forward body portion 360 comprises a guide tube generally designated 370 and having an inside diameter surface 372 which reciprocably positions a sleeve support unit generally designated 374. As shown, the forward body 370 also includes an outer diameter cylindrical surface 376 over which the sleeve material passes in use.

As shown in FIGS. **11*a*–11*d*** this material customarily lies flat and, although cylindrical in its expanded condition, in its flattened condition it presents top and bottom surfaces with inwardly folded webs or gussets forming either of its side edges.

Referring now to the positioning and operation of the sleeve support, it will be noted that this unit 374 is preferably made from a plastic material and includes a cylindrical body section 378 terminating in an enlarged nose 380 having a beveled leading edge surface 382 thereon. A bushing 384 located centrally of the sleeve support 374 is slideable over a sleeve support positioner 386 having a movement limiting stop 388 forming one end thereof and a threaded end portion 390 forming the other end. The threaded end 390 is positioned in a threaded locating boss 392 forming a part of the forward body unit 370. An operating spring 396 biases the sleeve support unit to an extended position.

FIG. 12 shows the operation of the shuttle system 276 in use and the functioning of the sleeve support unit 374. As shown in FIG. 11, when the sleeve material is advanced, a leading edge margin 274 is kept in a generally cylindrical, open-ended shape by surrounding the support unit 374; the nose portion 380 is disposed just outward of the leading edge of the sleeve. The outer cylinder and mandrel combination, in use is advanced to the left as shown in FIG. 11, with the guide bushings and rod 320, 322, 324 serving to align the center line of the mandrel with that of the feed guide 238. With a section of sleeve entrapped between the mandrel 314 and the cylinder 312 by the claws 348, the sleeve is advanced as shown in FIG. 11.

When shuttle motion continues, the nose portion 382 of the sleeve support 374 is engaged by an end face 398 of the guide tube 241. Continued movement of the mandrel and sleeve assembly causes the sleeve support 374 to retract inwardly of the sleeve, compressing the spring 396. This permits the margin 274 to extend outwardly or be cantilevered over the reduced thickness margin 272 of the tube 241.

When the margin 274 of the sleeve is so positioned and the carrier 328 has reached its full stroke length, the control energizes the compressed air source, feeding air through the tube and fitting 310 into the pressure chamber 284. This cams the fingers 300 downwardly, causing the finger pads to engage and hold the sleeve margin 274 securely.

Thereupon, the shuttle assembly 86 retreats or is withdrawn to the right, until it achieves the fully withdrawn position. The sleeve is held in this position as shown in FIG. 13, until the operating rod 250 is extended fully to the right, loading an entire group of articles into the sleeve interior. As shown in FIG. 13, since this array of articles is slightly compressible axially, a position such as that shown in FIG. 13 is achieved. Thereupon the operating rod 250 is rapidly withdrawn while the fingers 300 remain in their down and locked position of FIG. 13.

Before the individual articles in the group move axially to the left, and just as the plunger 246 is withdrawn, clamping blades 491, 492 (FIG. 15*a*) of a clamping assembly generally designated 416 (FIGS. 14–15) moves in the direction shown by the arrows in FIG. 13 to close off the end of the being-formed package. Thereafter, the fingers 300 may be released by permitting compressed air to flow from the chamber 284 through a bleed line; this permits the annular piston 286 to withdraw and the spring plungers 308 to pivot the fingers 300 upwardly to the position of FIG. 12, for example. At this point, the remaining section 401 of the sleeve 78 is an end forming flap having a free end portion previously secured over the end of the guide tube 241.

Referring now to FIGS. 11*a*–11*d*, in FIG. 11*a*, reference is made to the change in shape of the supply of sleeve-forming material as it moves from a storage location and becomes a package wrapper. FIG. 11(*a*) schematically shows a reel generally designated 402 to comprise supply means for a extended, continuous length of sleeve material 78. As the material is withdrawn from this reel 402 and advanced from time to time by the shuttle mechanism 84, it is transformed from a lay-flat cross section into a circular cross section.

FIG. 11(*d*) shows the sleeve material 78 to have upper and lower sheet portions 402, 404 joined at their ends by inwardly double folded gussets 406, 408. FIG. 11(*c*) shows that as the material is thus unfolded, the inwardly extending directed or re-entrant gusset expand as the upper and lower portions 402, 404 move apart. Finally, as a result of being trained over the mandrel 314, the sleeve 78 assumes a substantially circular cross section suitable for receiving can ends.

If a manufactured article having a different cross sectional shape were selected, an appropriate unfolded shape could be assumed by sleeve material, which is preferably formed as just described for purposes of convenient storage.

Figure 14:
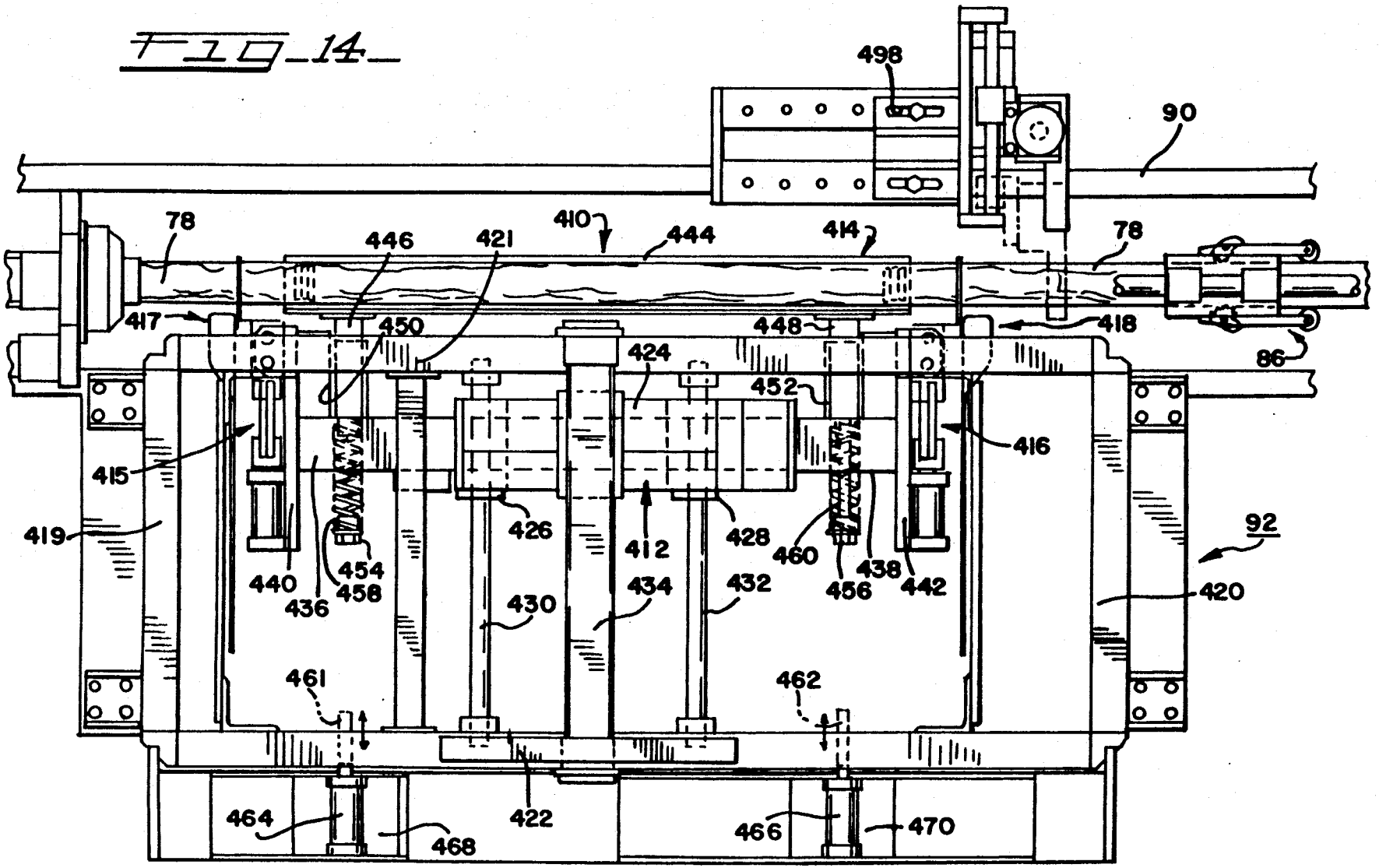
FIG. 14 is a top plan view of the side frame unit of the apparatus, showing the elements for positioning the sleeve, for supporting it during package formation, and certain aspects of the mechanism used to support the package, tension the sleeve, cut the sleeve to length and form and fold end-forming flaps on the sleeve being formed into a package.
Figure 15:
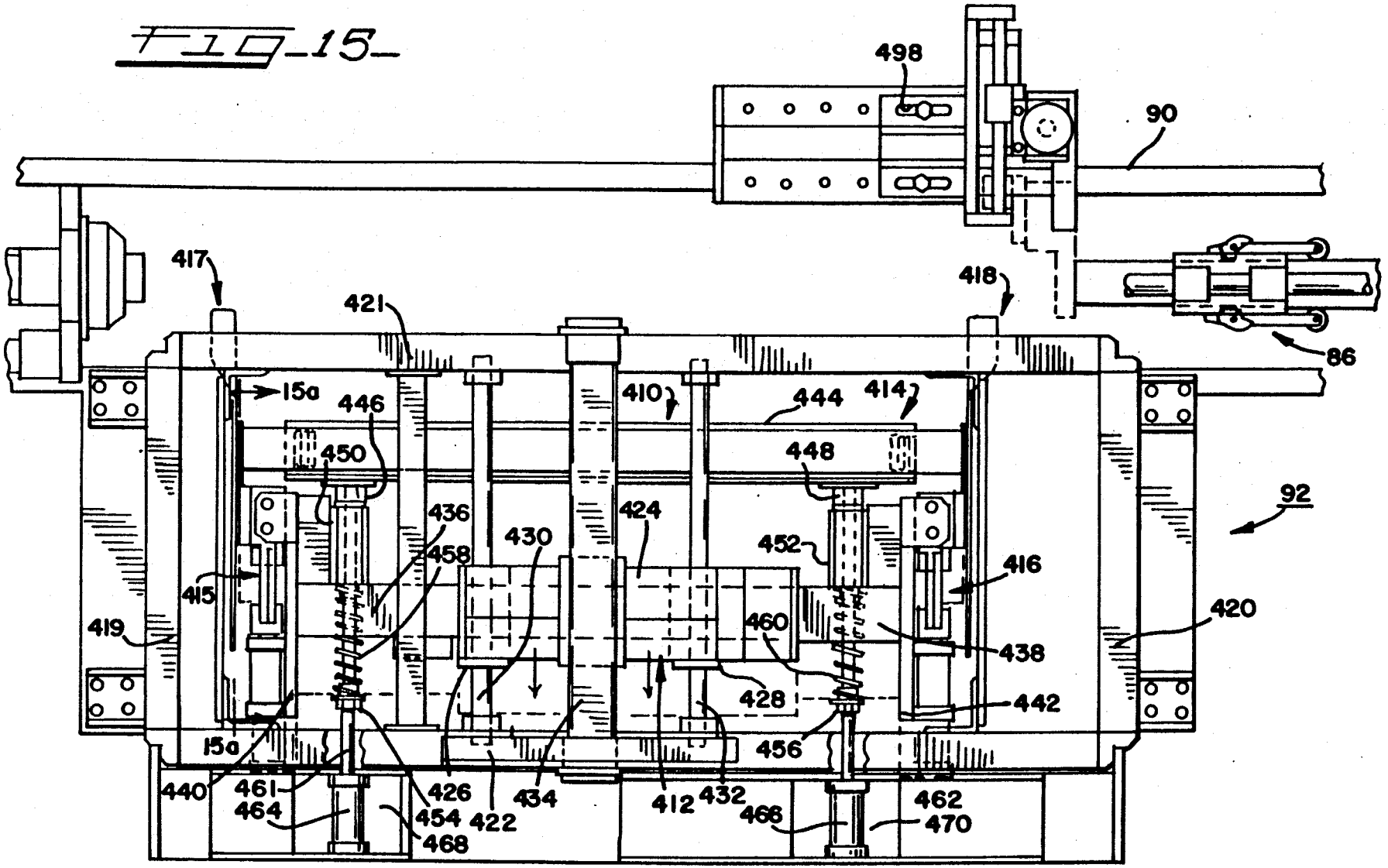
FIG. 15 is a top plan view of the apparatus of FIG. 14, showing it in another position of use.

Referring now to FIGS. 14 and 15, there is shown an enlarged detail of the side frame unit 92 affixed to the main longitudinal frame 90 of the packaging unit 34. The side frame 92 serves to position a package support and transfer assembly generally designated 410 and shown to include a number of principal elements, including a carriage unit generally designated 412, a reciprocable tray assembly 414, a pair of camping assemblies generally designated 415, 416 and a pair of plow units generally designated 417, 418 for folding an end flap on the package being formed.

Referring again to FIGS. 14 and 15, the side frame 92 includes a plurality of spaced apart transverse rails 419, 420 and a pair of longitudinal rails 421, 422. These rails 419-422 serve to position the carriage unit generally designated 412, which is shown to include a carriage cross frame 424 having cylindrical bushings 426, 428 surrounding portions of, and moving along, transverse guide rods 430, 432.

A "Tol-o-matic" cylinder unit 434, the constructional details of which have been referred to elsewhere herein, provides power to move the carriage laterally of the article group feed axis, that is, towards the top and bottom as shown in FIG. 14, a plan view of the unit. In addition, the carriage unit 412 also includes a pair of outer frame extensions 436, 438 which terminate in and are affixed to clamp support frame assemblies 440, 442. Consequently, reciprocation of the carriage unit 412 will cause movement of the parts associated with the carriage, as will now be described.

Figures 15A, 17, 18:
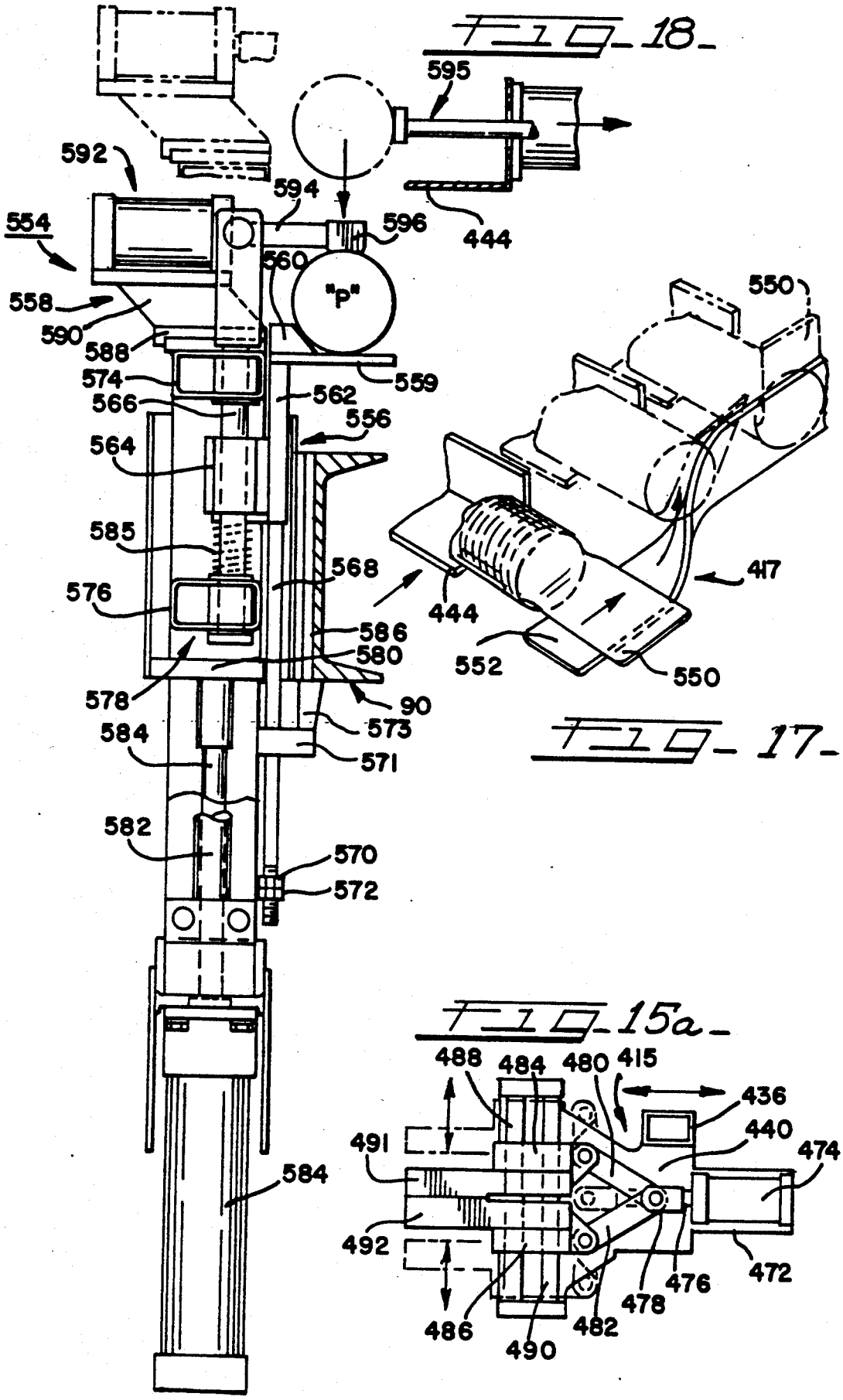
FIG. 17 is a perspective view of a portion of the plow unit used to form and fold end flaps on the being-formed package made by the apparatus of the invention.
FIG. 18 is an end view, partly in elevation and partly in section, showing the portion of the apparatus used to move the package being formed from a position of article insertion to a position wherein its end flaps are held and tape is applied to seal the package end.
Figure 18A:
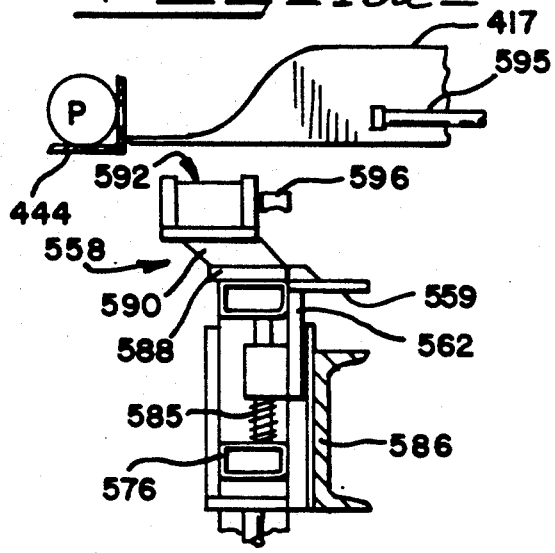
Figure 18B:
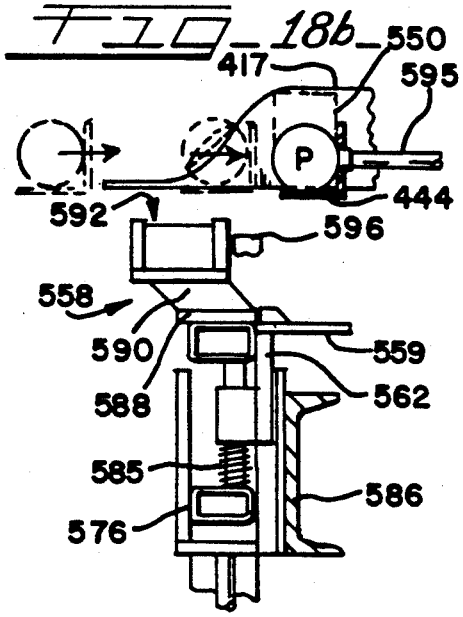
Figure 18C:
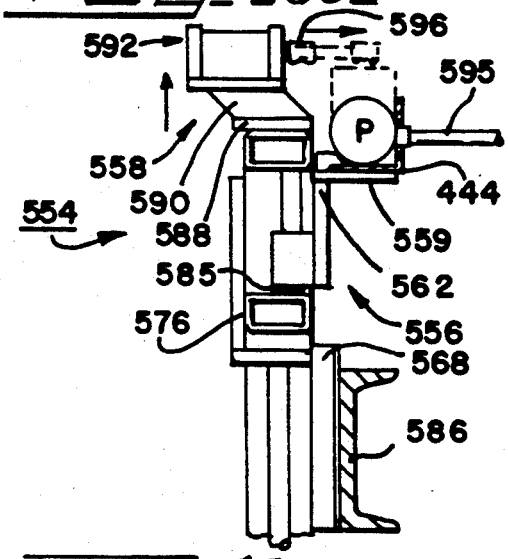
Figure 18D:
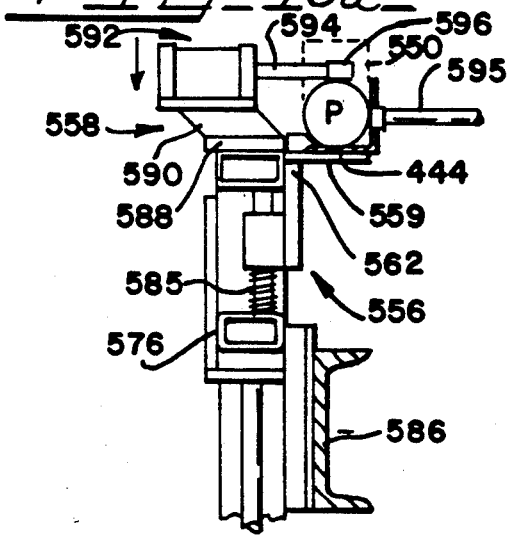
Figure 18E:
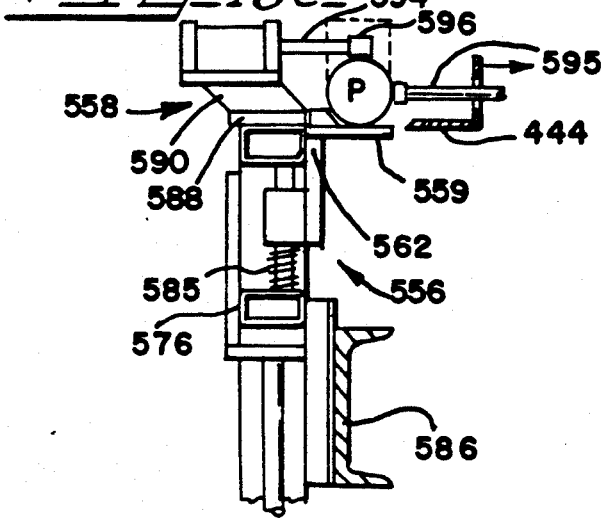
Figure 18F:
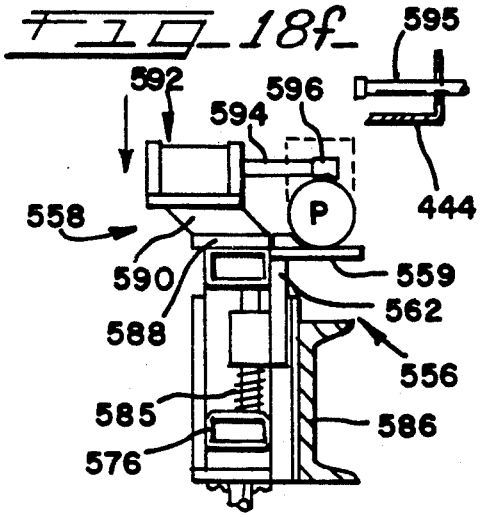

Referring first to the tray assembly 414, this includes not only means in the form of a right angle package support section 444 (see also FIG. 18(*a–f*)) for use during the time package sleeve is being filled, but also includes a pair of tray positioning rods 446, 448 riding within bushings 450, 452 affixed to the carriage cross frame 424. Remote end portions 454, 456 of the rods 446, 448 are kept extended relative to the cross frame unit 442 by captive compression springs 458, 460. Hence, movement of the carriage cross frame 424 will tend to, but not necessarily cause, a counterpart movement of the support section 444. The clamp assemblies 415, 416, are fixed to the cross frame 424 and thus will exactly replicate movement of the frame 424.

Thus, while the carriage unit 412 moves between fully extended and fully withdrawn positions, the tray assembly 414 is arranged so that it will remain in an intermediate position, i.e., the position shown in FIG. 15. This is because, when the rod end portions 461, 462 of a pair of positioning cylinder assemblies 464, 466 are extended, their ends engage rod ends 454, 456 preventing fully withdrawn movement of the tray 414. The full withdrawal of the carriage unit 412 is effective to compress the springs 458, 460 during this phase of the operation, but the tray 414 is held as shown. Only after the package has been unloaded and removed to a lower position for taping, as will be described, are the piston and cylinder assemblies 464, 466, (which are positioned on brackets 468, 470 secured to the longitudinal cross frame rail 422,) deenergized and the end portions 461, 462 are withdrawn or retracted to the solid line position of FIG. 14. This then permits the tray 444 to move fully to the rear or withdrawn position prior to performance of another operating sequence.

Referring now to FIG. 15(*a*), certain constructional details of one of the clamping assemblies 415 are shown. Both assemblies are identical, so only one will be described in detail. A typical assembly 415 has its clamp support frame 440 affixed to the outer frame extension 436. The support frame 440 includes a plate 472 on which a piston and cylinder assembly 474 is mounted. The operating rod 476 of the assembly 474 terminates in a clevis 478 to which are pivotally secured a pair of operating arms 480, 482. Each of these is mounted at its remote end portion to a blade mounting unit 484, 486; and each blade mounting 484, 486 is guided by vertical rods 488, 490.

Consequently, in and out movement of the operating rod 476 will result in a vertical reciprocation of the mounting units 484, 486. Each of these units has a clamping blade 491, 492 formed therewith or affixed thereto. Thus, a clamping action having the degree of force desired to be supplied by the air cylinder 474 may be generated in this assembly 415. The force applied to clamping the sleeve material 78 is effective both to tension the sleeve and to subdivide the package into a center section filled with articles, and two end flap forming sections.

As pointed out, in normal use, as the carriage 412 moves from a withdrawn position toward the centerline axis of the article feeding station, the blades 491, 492 are positioned in the open or widely spaced apart position. Prior to time the group of articles 52 is inserted, the downstream clamping cylinder (the right hand cylinder as shown in FIGS. 14 and 15) is actuated, forming, in effect an end stop for the group of inserted articles; the left hand or upstream clamping unit (relative to article movement) remains open until after the operating rod 250 has completed its forward stroke pushing the articles into the sleeve and applying a compressive force thereto, and has withdrawn.

Thereafter, the upstream clamping blades 491, 492 are moved together to grip the package end. This action also tensions a portion of the packaging sleeve 78 between the downstream clamping unit 416 and the withdrawn position of the shuttle assembly 86, enabling the sleeve 78 to be easily cut by the sleeve cutter unit 88, in a manner which is described herein.

After the sleeve 78 has been cut and the clamping blades have tensioned the package, the carriage drive is energized, and the carriage withdraws both the tray 414 supporting the package and the end clamping units 415, 416 to the position of FIG. 15, wherefrom the package will be lowered. Prior to this lowering action, however, the sleeve is cut as mentioned, and also, as will be described blow, a vertically extending end flap is formed on each end of the package.

Figure 16A:
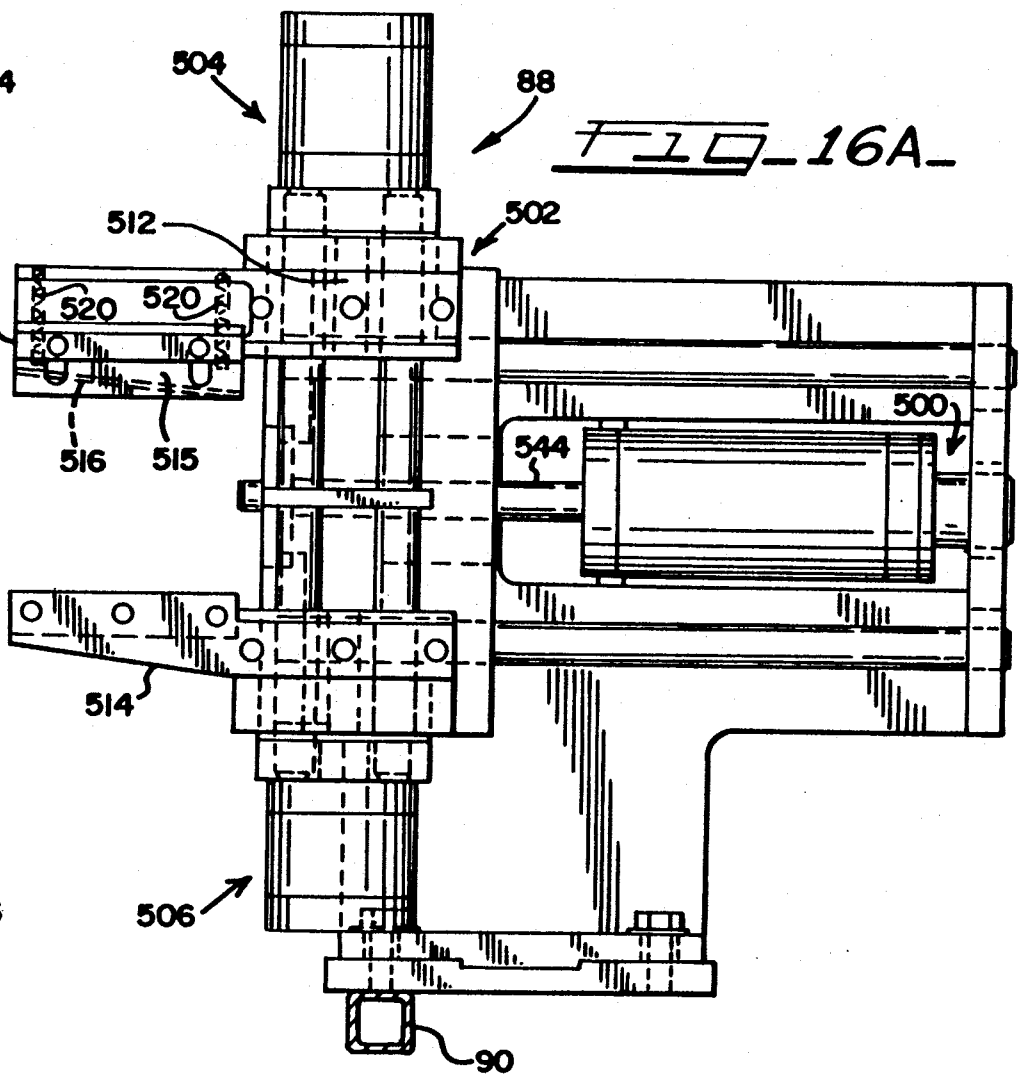
FIG. 16 is an enlarged side elevational view of the sleeve cutting apparatus of the invention.
Figure 16:
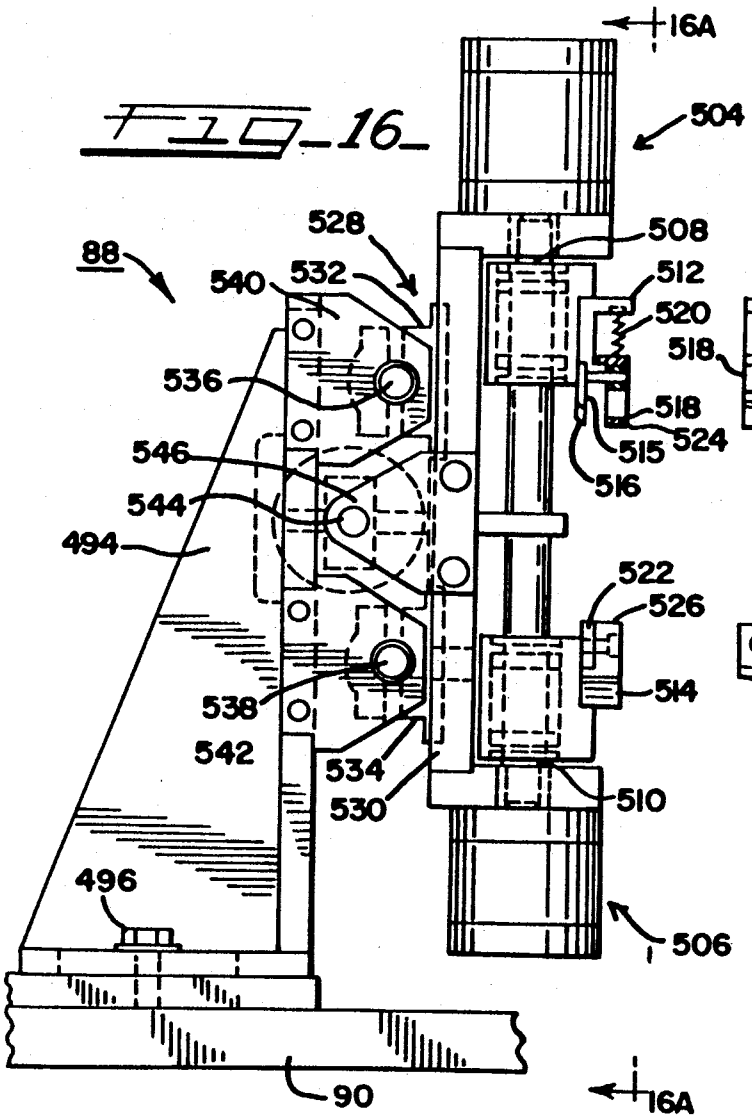

Referring now to FIG. 16, the construction and operation of the sleeve cutter 88 will be described. As shown, this unit 88 is mounted by a right angle bracket 494 secured to the main frame 90 in a suitable manner; the mounting bracket 494 includes removable fasteners 496. As best shown in FIGS. 14 and 15, the bracket 494 includes elongated slots 498 as well as a series of other openings to facilitate adjustable positioning of the unit 88. In this way, the position of the cutter 88 relative to the clamping unit 416, and hence the length of the end-forming flaps is determined.

In its simplest form, the cutter 88 may be envisioned as having a piston and cylinder assembly 500 (FIG. 16*a*) adapted to extend and withdraw the cutter subassembly generally designated 502, and another pair of piston and cylinder assemblies generally designated 504, 506 for vertically reciprocating associated cutter blades to sever the sleeve 78. In this connection, each of the upper and lower cylinder assemblies 504, 506 includes an operating rod 508, 510 having blade holder frames 512, 514 secured thereto. The upper blade holder frame 512, positions a blade 55 with an inclined cutting edge 516. The upper blade holder also includes a hold-down foot 518 which is resiliently positioned by a pair of springs 520. The lower frame 514 has a flush insert blade 522.

Hence, when the actual cutting operation is performed, the lower surface 524 of the foot 518 engages the sleeve held on the upper surface 526 of the lower blade holder 514, and further downward movement shears the sleeve.

The entire cutter subassembly 502 just described is mounted for reciprocation on a transport frame generally designated 528 and having a main frame unit 530 which is generally "C" shaped in end elevation. This frame 530 includes upper and lower mounting ears 532, 534 having openings secured about and journaled for travel along the length of upper and lower guide rods 536, 538 which are in turn secured to rod mounting end brackets 540, 542.

The movement of this assembly transversely of the feed axis of the article groups is achieved by operation of the cylinder 500 which includes an operating rod 544 extending therefrom and secured by a rod bracket 546. In use, as just described, the sleeve cutter operating sequence is such that, after the shuttle unit 86 is withdrawn and the clamping blades 491, 492 on the leading edge or downstream clamping unit 416 are actuated, the cutter 88 is traversed into position and the blades reciprocate vertically to perform the cut. Thereafter the blades are separated and the extensible subassembly 502 is withdrawn from its position on the group feed axis.

Referring now to FIG. 17, a somewhat diagrammatic illustration of the manner of forming the package end flaps is shown. Here, one of the plows generally designated 417 and comprising the means for forming and folding the package end flap is illustrated. For purposes of clarity, while the tray section 444 which supports the package is shown along with a series of phantom lines steps in its movement sequence, the clamping assembly is not illustrated. However, it will be understood that the blades of the associated clamping arm are positioned closely adjacent both the end article within the package and the plow 417 (see FIGS. 14 and 15). When this is done, a lay flat portion 550 of the sleeve is formed and this will rest on the horizontal plate portion 552 of the plow 417. Because of its contour, as the tray 444 is withdrawn, the end flap 550 is folded into a vertical position as illustrated, finally achieving the phantom line position shown to the right in FIG. 17. A plow 417 or 418 is provided for each end of the package.

Referring now to another component of the apparatus of the invention, FIG. 18 shows a positioner assembly generally designated 554 for removal and taping of the just-formed package. This unit 554 is subdivided into a package platform assembly generally designated 556 and a package hold-down assembly generally designated 558. These units cooperate in removing the formed package from the tray section 444 forming a part of the transfer apparatus 410 and lowering it to a position wherein one or both of the end flaps 550 may be taped to the remainder of the package in a manner which will be described; the operation involves lowering the package into alignment with the taping equipment, usually a distance of 3 to 5 inches, for example.

Referring now to the package platform assembly 556, this unit includes a flat package platform 559 having an edge rail 560 forming one side thereof to prevent movement of the package toward the free or left side as shown in FIG. 18. The platform 559 is positioned by a platform support bracket 562 which in turn includes one or more guide bushings 564 having portions encircling associated guide rods 566.

In addition a movement limiter rod 568 extends downwardly from a lower edge of the platform support bracket 562. The rod 568 has adjustment and locking nuts 570, 572 positioned near its lower end. The lower end extends through a movement limiting stop collar 571 positioned by a bracket 573. The guide rods 566 extend between upper and lower subframe tubes 574, 576, forming portions of a positioner subframe 578; this subframe 578 is in turn secured to a carrier bracket 580 which rests upon an end portion of a vertically movable platform extension rod 582. The opposite end portion of the rod 582 lies within the piston and cylinder assembly 584 which is pneumatically operable to raise and lower the elements referred to in a manner described herein.

A preloaded lost motion spring 585 extends between the bushing 564 and the lower subframe tube 576, permitting the subframe 578 to move relative to the platform assembly 556. Both subassemblies are movable relative to the heavy channel section 586 forming a part of the longitudinal main frame 90 of the packaging apparatus 34.

The tube portions 574, 576 of the positioner subframe 578 carry the guide rods 566 just described, and these rods 566 terminate at their upper ends in a bar positioning cylinder support bracket 588 having an offsetting section 590 supporting a bar positioning cylinder assembly 592. The cylinder assembly 592 includes an extensible hold down rod 594 having a contoured hold down bar 596 affixed to its outer end.

Because of the foregoing arrangement, wherein the positioner spring 585 is disposed between the lower tube 576 and the guide bushing 564, when the operating cylinder 584 is energized, the carrier bracket 580 will move upwardly, carrying with it both the bar positioning cylinder assembly 592 and the package platform assembly 556.

When the platform assembly 556 reaches a certain height, the adjustment nut 570 on the movement limiter rod 568 will engage a lower surface of the stop collar 571 positioned by the bracket 573 on the frame member 90.

This will arrest further upward movement of the package platform assembly, but the carrier bracket 580, the subframe 578 and its associated components will continue to move upwardly, compressing the lost motion spring 585 and raising the cylinder 592 and its associated components relative to the platform.

This creates an open space of a height sufficient to provide working room for receiving the package. Deenergizing the cylinder 584 to lower the assembly as a whole will first cause the hold down bar 596, which has been previously extended by energizing the cylinder assembly 592, to engage the upper surface of the package "P". This will secure the package "P" against falling during removal and transfer as is clearly shown in FIGS. 18(*a–f*).

Referring now to FIGS. 18(a-f), it is shown that the transfer tray section 444 is positioned to the left or along the center line or feed axis of the article group 52. Assuming that the package sleeve has been filled while supported by the tray section 444, and that the clamping fingers were appropriately actuated, the being-formed package is removed after a portion of the sleeve 78 is severed by the cutter unit 88.

FIG. 18(*b*) shows the withdrawal of the package while held on its support tray past the end flap forming plows 417, 418, thus forming end flaps 550 as shown in dotted lines. The tray section 444 is then stopped while spaced well above but vertically in line with the support platform 559. This is accomplished when, as shown in FIG. 15, the rods 446, 448 are engaged by the rod ends 461, 462. The fixed package ejector 595 in FIGS. 18(*a–f*) which ends through an opening 593 in the tray section 444 then just engages a side wall portion of the package.

As shown in FIG. 18(*c*), the entire positioner assembly 554 is raised until the movement limiter rod 568 prohibits further upward movement of the platform assembly 556; this stops the platform 559 just beneath the lower surface of the support tray section 444.

Upward movement of the package hold-down assembly 558 continues as the spring 585 is compressed. Because of the offset plate 590 forming a part of the cylinder support bracket 588, the bar positioning cylinder assembly 592 the hold-down bar 596 and the rod 594 positioning it are able to move vertically past the package i.e., to the left in FIG. 18(*c*). When the maximum vertical height of the hold-down assembly is reached (FIG. 18(*c*) the cylinder 592 is actuated and the hold-down rod 594 extends fully such that the hold-down bar 596 is positioned atop the package, adequate clearance to permit such extension being provided by the lost motion just described.

Thereafter, the operating cylinder 584 is operated in the "down" direction and the hold-down bar 596 contacts the upper surface of the package "P" as downward movement of the platform 559 is about to begin. Next, as shown in FIG. 18(*e*) the tray is removed to the right. The ejector bar 595 being fixed, however, it holds the package above the platform and permits withdrawal of the tray 444. This in turn occurs as the cylinders 464, 466 (FIGS. 14, 15) are deenergized and the springs 458, 460 extend, carrying the tray 444 fully to the rear. Thereupon, the package is supported solely by the platform assembly 556.

As shown in FIG. 18(*f*), the platform assembly 556 and hold-down assembly 558 move together as a unit, until the package entrapped therein is moved to the position at which taping will occur. The foregoing apparatus thus serves to utilize lost motion to provide an insert gap for the package, and permits the package "P" to be positively retained while the support tray is withdrawn from its transfer position beneath the package.

Referring now to FIGS. 19–21 and 22(*a–f*), a somewhat schematic construction and operational illustration of a tape applicator apparatus made in accordance with the invention is shown.

Figure 19:
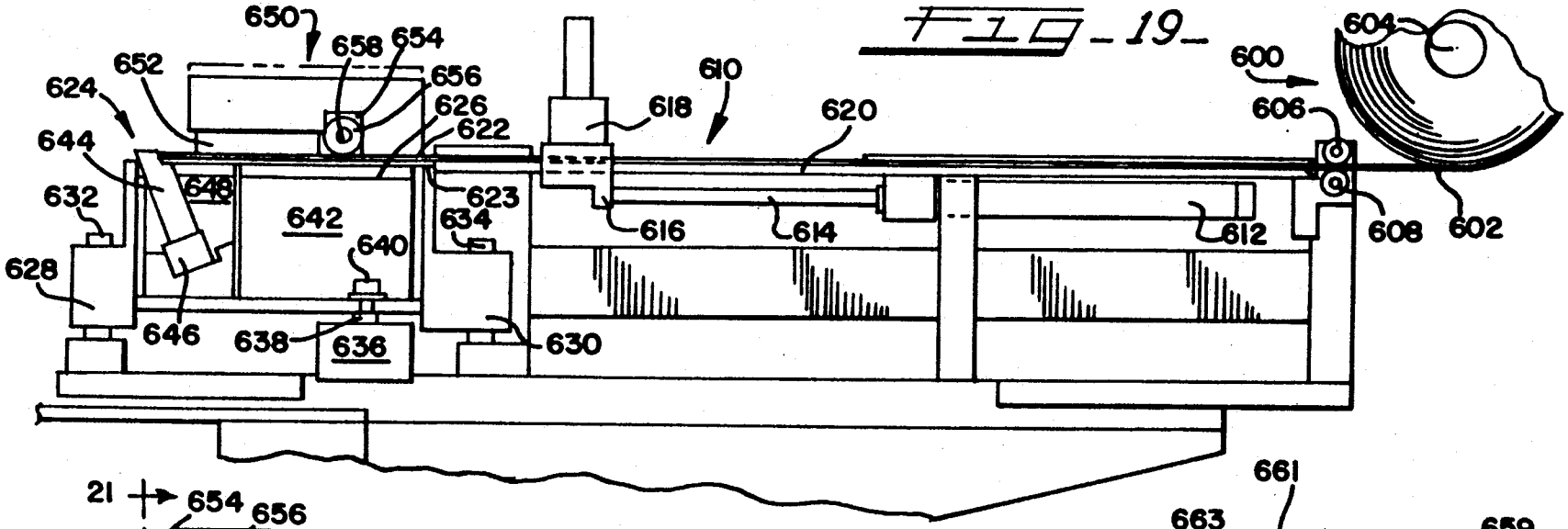
FIG. 19 is a side elevational view of the tape storage, advancing and application mechanism of the invention.

As shown in FIG. 19, the apparatus is generally intended to advance, wet, and dispense tape, such as a paper tape containing a water remoistenable adhesive, in individual lengths which are applied first to the top surface portion of the package adjacent the end, and then down along the end face of the package.

The presently preferred form of apparatus, as shown in FIG. 19, includes a tape supply reel generally designated 600, containing a supply of tape 602 wound about a roller 604. The tape is then trained through a pair of opposed feed guide rollers 606, 608, and fed through a narrow channel in a horizontal direction by a tape forwarding assembly generally designated 610. The forwarding assembly 610 includes an operating piston and cylinder unit 612, and an operating rod 614 affixed to a tape clamping frame generally designated 66. A pinch clamp cylinder assembly 618 is secured to the clamping frame 616.

In operation, the pinch clamp cylinder 618 moves the outer margins of a pinch clamp (not shown in detail) into engagement with the lateral margins of the tape; after the tape is gripped, the operating rod 614 extends forwardly and advances a length of the tape equal to the rod stroke through slotted guide plates 620. At the end of these guide plates 620 is a cutter bar 622, disposed opposite a cutter bar 623 which forms a portion of a vertically reciprocable tape repositioning assembly generally designated 624.

The tape repositioning assembly 624 includes a main body portion generally designated 626, and a pair of opposed cylindrical guide bushings 628, 630 surrounding vertically extending guide rods 632, 634. The body 626 is moved by a positioning cylinder assembly 636 having the end portion of its operating rod 638 secured by a fastener 640.

Figure 21:
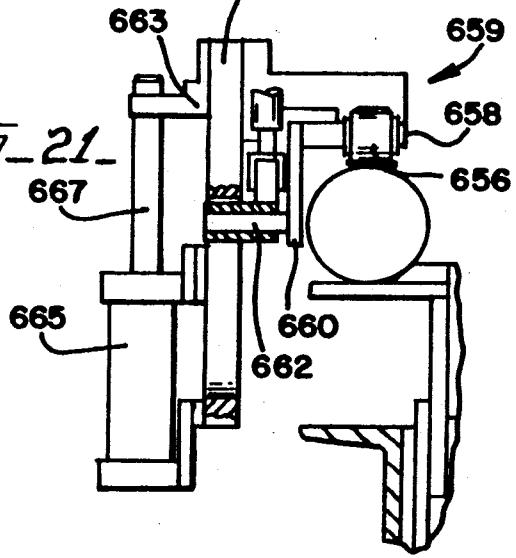
FIG. 21 is a vertical sectional view, taken along lines 21—21 of FIG. 20 and showing the tape applicator roller relative to the package having an end being taped.
Figure 20:
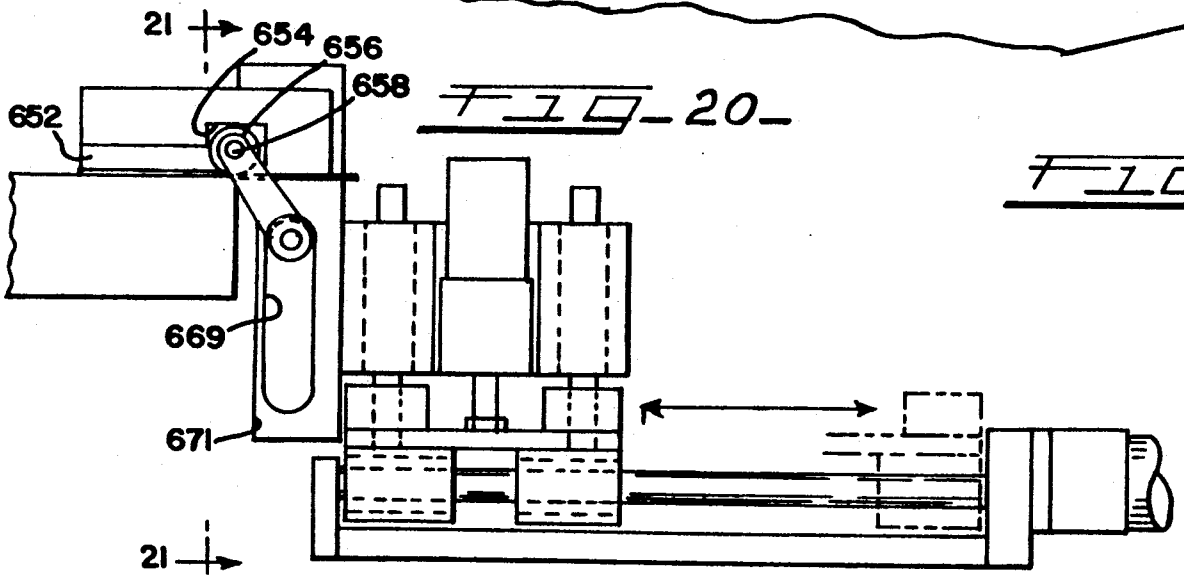
FIG. 20 is a side elevational view, partly diagrammatic in nature, showing one step in the method of applying a section of tape to a package.
Figure 22A:
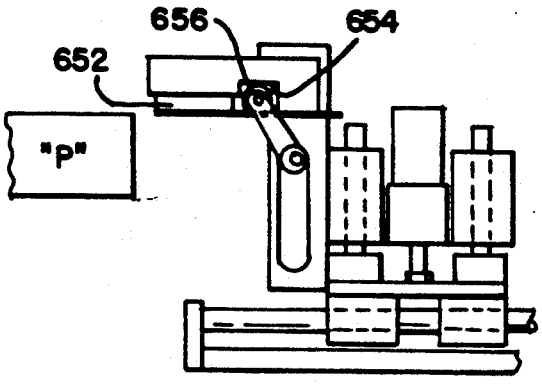
FIGS. 22(*a—f*) are diagrammatic views showing certain sequence of the steps performed by the tape applicator in use.
Figure 22B:
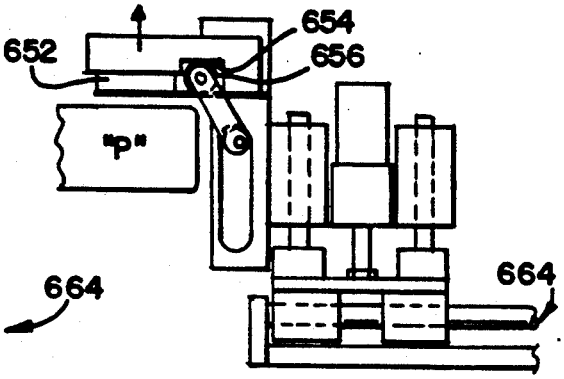
Figure 22C:
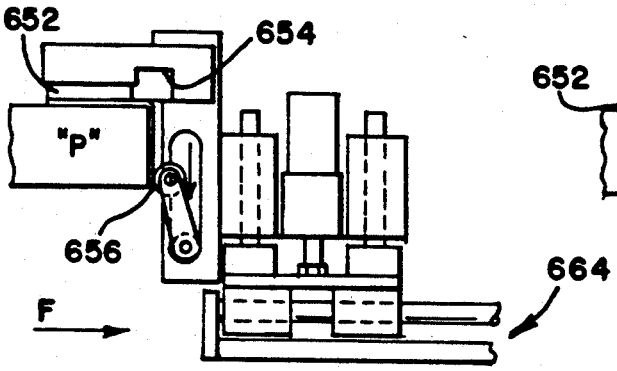
Figure 22D:
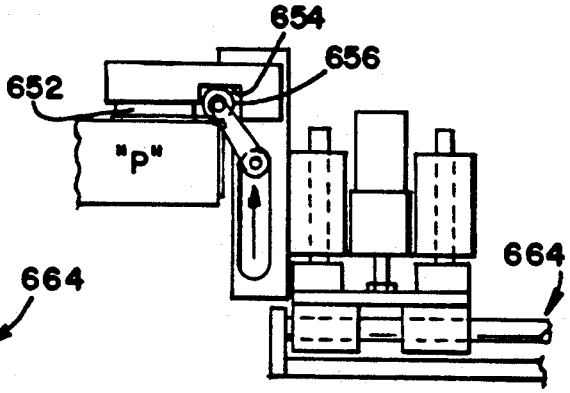
Figure 22E:
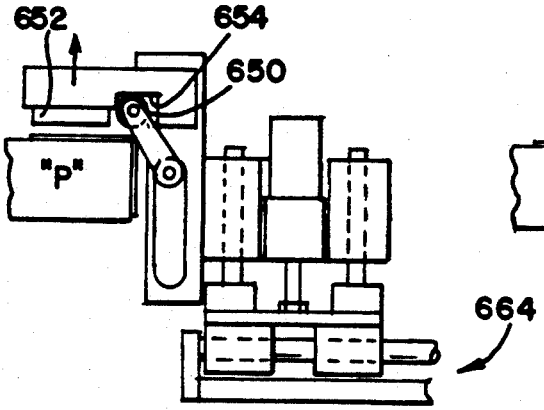
Figure 22F:
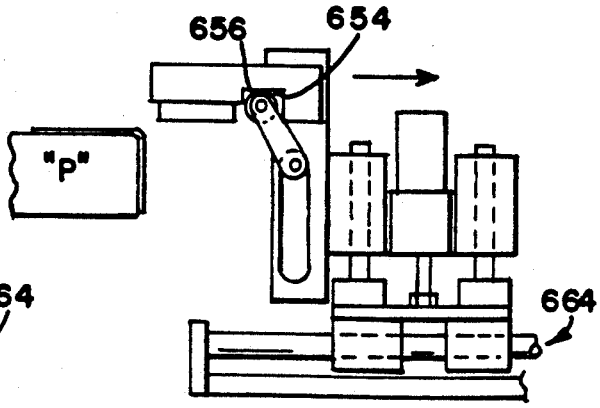

The body 626 also includes a reservoir 642 for receiving a supply of liquid which is fed to a brush unit 644 having its end portions secured in a brush holder 646; when sufficient liquid is fed to the brush holder chamber 648, capillary action wets the tip portion of the brush. The body 626 is surmounted by a vacuum head assembly generally designated 650, which in turn includes a tape pick-up portion 652 disposed beneath the vacuum head 650; the head assembly 650 also includes a vertically extending slot generally designated 654 for receiving a roller 656 positioned for rotation about an axle 658. In FIG. 19, some of the operating structure of the roller assembly generally designated 659 are hidden from view. FIG. 21, however, shows the principal elements, which include a roller frame 661, a frame bracket 663, and a cylinder assembly 665 with an operating rod 667. The roller axle 658 is positioned by an arm 660 which pivots about a pin 662; a spring (not shown) biases the upper or roller end of the assembly to the left as shown in FIG. 20.

As will now be described in detail, after a length of tape has been advanced so as to lie beneath the pick-up unit 652, both it and the repositioning unit 624 are raised together such that the tape then lies above its feed axis. This causes the cutter bars 622, 623 to shear the tape. When in the elevated position, vacuum is applied to the tape top surface, which is retained in the lower surface of the pick-up unit 652, as shown in FIG. 22(*a*).

Next, and referring now to FIG. 22(*c*) and 22(*b*), the tape has been passed over the brush and has been wet, by reason of the pick-up unit 652 having moved from the position of FIG. 19 to that of FIG. 22. The tape was retained by the vacuum in pick-up head 652 while being further raised, as shown in FIG. 22(b), so as to now lie above the upper surface of the package "P". At this point, the roller remains within its slot 654.

The entire head support unit generally designated 664 in FIGS. 22(*a–f*) is then moved fully to the left as shown in FIGS. 22(*b–e*). When the positioner has moved to the position of FIG. 22(*b*), it has passed through an aperture 669 in an end plate 671 which holds the package end. As shown in FIG. 22(*c*), when the pick-up 652 is positioned over the package, the unit 652 is then lowered so that the lower, wetted surface of the tape engages the upper package surface, permitting the tape to begin adhering to the package. During this time, the package "p" is urged against the end pate 67 by a force F (FIG. 22c) supplied by a cylinder or the like (not shown).

Thereupon, the roller support unit 666 (FIG. 21) is lowered and the tape is wiped along the end face surface of the package by the roller 656. Next, as shown in FIG. 22(*d*), the roller assembly is returned to its uppermost position and permitted to reenter the slot. Thereafter, as shown in FIG. 22(*e*), the entire assembly is raised out of contact with the package end, and then shown in FIG. 22(*f*), withdrawn from its position overlying the package.

In this connection, it will be understood, that the head support unit is capable of significantly greater movement to the right, at which point it will be positioned as shown in FIG. 19. Here, it can be reloaded. The vacuum head and related components shown in detail in FIG. 20 and 22(*a–f*) lie partially behind the tape positioning and wetting unit.

Referring now to one aspect of the overall operation of the machine, no detailed description has been given of the control system of the invention, since this system is not a necessary part of the operation of the apparatus of the invention. Thus, while an inventive form of control unit might be used with the apparatus, its essential operation may be conducted simply by a series of detectors and a proper sequencing control. Thus, after a certain number of ends has passed the integrated mover, the forwarding unit may be energized; a proximity switch determines the arrival of a group of articles at the end of an inbound lane. A simple memory is adequate for positioning the pick-up head and it descends for pick-up and for drop-off of groups of articles when so positioned. Other sequencing controls are used to initiate advancing of the shuttle, positioning and gripping of the sleeve, and clamping one end thereof, following which an insertion of articles is made.

When the insertion operation is completed, the second clamp operates, as described above. Cutting the sleeve, transferring the package and positioning it for subsequent repositioning to the tape applicator may carried out by sequencing controls of a known type. Hence, means of any known type is provided to ensure that a given operation is not undertaken before the necessary preconditions have been achieved. Travel limit switches, proximity detectors, and the like may be provided for operating controls and for safety measures as may be indicated.

The invention has been described in detail with respect to stacks of can ends, which readily nest with each other and which have a circular cross section. Of course, if other types of manufactured articles are processed by an apparatus falling within the spirit of the invention, the handling apparatus would be suitably shaped for reception and handling of such articles. Likewise, the cross section of the sleeve and other elements would be appropriately shaped for such articles.

According to the invention, kraft paper is used to wrap the articles in question, since this is a material which has historically proven satisfactory in the beer and beverage industry. Water remoistenable type natural glue adhesives are accepted in this industry. However, other wrapping materials may be used, such as plastics of various kinds, if they are otherwise appropriate for the end use considered. Pressure sensitive or solvent-containing tapes or heat activateable or hot melt products might likewise be used if there use is acceptable from other standpoints.

Throughout the specification, "Tol-o-matic" brand cylinder positioners have been illustrated as being used in our preferred for use with the invention. However, other pneumatic, electric or hydraulic or purely mechanical positioners might be used if desired.

The machine described has been laid out in such a manner that most of the operations occur in a single plane, with only the taping and movement to storage area being carried out a few inches beneath the plane on which the articles are grouped, cross fed, inserted, and package ends formed. However, the machine could clearly be constructed such that the spacings might be vertical rather than horizontal. Where relative motion is illustrated, in many cases, as is known to those skilled in the art, the relatively fixed and movable elements might have their functions reversed without loss of effectiveness.

It will thus be seen that this invention provides a novel packaging apparatus and method having a number of advantages and characteristics including those pointed herein and others which are inherent in the invention. A preferred embodiment having been described by way of example it is anticipated that modifications may be made to the described form of apparatus and methods without departing from the spirit of the invention of the scope of the appended claims.

We claim:

1. An apparatus for successively packaging groups of articles in a tubular sleeve, said apparatus including means for receiving a group of substantially identical articles arranged in end-to-end relation, means for receiving a continuous length of pre-formed wrapping sleeve material and positioning it for feeding its free end downstream to a package-forming mechanism, and a package-forming mechanism which comprises in combination, reciprocable means for engaging the margin of said sleeve adjacent said free end of said sleeve material, transport means for advancing said margin-engaging means and a package-forming section of said sleeve in a downstream direction from a first position to a second position adjacent an article group insertion area, means for positioning said sleeve margin in said insertion area so as to provide an end opening in said sleeve for entry of said article group, means for releaseably retaining said free end margin in said open position in said insertion area, said transport means further including means for returning said sleeve margin engaging means to said first position, means for inserting said group of articles into said open ended sleeve, first and second, spaced apart clamping means for engaging said sleeve and thereby subdividing said sleeve section into a central portion containing said group of articles and first and second end flap forming portions of said sleeve section lying respectively downstream of said first clamping means and upstream of said second clamping means, means spaced upstream of said second clamping means for cutting said sleeve material means so as to separate the package formed from said sleeve section from said continuous length of sleeve material and form a new free end thereon, means for folding said end flap forming portions such that end flaps closing off the end portions of said package body are created, and means for transferring said packages thus formed to a package storage area.

2. An apparatus as defined in claim 1 which further includes means for taping at least one of said end flap forming portions of said sleeve to an adjacent end portion of said package body.

3. An apparatus as defined in claim 1 which further includes means for continually supplying pre-formed groups of articles to said means for receiving said groups of articles.

4. An apparatus as defined in claim 1 wherein said articles are can ends, and wherein said ends include countersink-forming portions whereby said ends are in nested relation when grouped.

5. An apparatus as defined in claim 1 wherein, said means for receiving said continuous length of wrapping sleeve material comprises a supply reel, and wherein said sleeve material is continuous length of kraft paper in tube form, folded into a lie-flat position.

6. An apparatus as defined in claim 5 wherein said material when in said lie-flat position, includes gussets folded inwardly on themselves and lying on opposite sides of said length of material.

7. An apparatus as defined in claim 1 wherein said reciprocable means for engaging said sleeve margin comprise a shuttle assembly having an outer cylinder and an inner, coaxially arranged mandrel, said cylinder and mandrel being spaced apart by a working clearance permitting passage of said sleeve material there through.

8. An apparatus as defined in claim 7 ,wherein at least one of said cylinder and mandrel includes material-engaging rollers and at least the other includes roller pockets, whereby said working clearance between said cylinder and mandrel may be maintained in use when said sleeve forming material is disposed within said working clearance.

9. An apparatus as defined in claim 7 wherein said transport means for advancing and returning said shuttle assembly comprises cooperating guide means on said cylinder and on another portion of said apparatus, and an actuator adapted to move said cylinder between said first and second positions.

10. An apparatus as defined in claim 1 wherein said means for positioning said sleeve margin in said insertion area includes a cylindrical collar having a cylindrical margin on the outer surface of one end thereof for receiving said sleeve margin, said cylindrical margin having a diameter just smaller than the inside diameter of said sleeve material and just larger than the diameter of said articles to be packaged.

11. An apparatus as defined in claim 10 wherein said means for releaseably retaining said free end margin comprises a plurality of gripping fingers disposed about the periphery of said collar, said gripping fingers being mounted for pivotal movement between engaged and released portions of said sleeve margin.

12. An apparatus as defined in claim 11 wherein said means gripping fingers are associated with a single annular pneumatic piston,, whereby said fingers may be operated simultaneously by the application of air pressure.

13. An apparatus as defined in claim 1 wherein each of said spaced apart clamping means comprises a pair of opposed fingers movable between open and closed portions, said clamping means further including finger actuators and guide means constructed and arranged so that said fingers are positioned and remain parallel to each other during operation.

14. An apparatus as defined in claim 13 which further includes a support frame for said fingers, said support frame being mounted for reciprocation perpendicular to the axis along which said articles are fed into said sleeve, whereby said package may have its ends retained between said clamping fingers as said package is transferred toward said storage area.

15. An apparatus as defined in claim 1 wherein said means for inserting said group of articles comprises a pusher rod having an end portion engageable with an end article in said array of articles, said inserting means further including a two-way actuator for said pusher rod.

16. An apparatus as defined in claim 1 wherein said means for receiving said group of articles comprises a channel of generally semi-circular cross-section, having at least one open end, said channel being aligned with an article insertion guide element.

17. An apparatus as defined in claim 1 wherein said means for folding said flaps comprises at least one stationary plow positioned adjacent said one of said clamping means, whereby moving said package moves said flap past said plow to form said end flaps by folding.

18. An automated apparatus for successively making double-ended packages of stacked articles, said apparatus comprising: an insertion station whereat a stack of articles is inserted into an open end of a sleeve of packaging material; stack-receiving means adjacent one side of the insertion station for receiving a stack of articles; releasable end gripper means disposed adjacent the insertion station opposite the stack-receiving means and in alignment therewith for receiving and positioning the open end of the sleeve at the insertion station; sleeve feeder means for advancing said open end of the sleeve from a continuous sleeve supply to the end gripper means; inserter means for advancing a stack of articles from the stack-receiving means to the insertion station and through said open end into the sleeve; first and second, spaced-apart clamping means, said first clamping means being disposed adjacent said end gripper means and said first and second clamping means being disposed intermediate the end gripper means and the continuous sleeve supply, said first and second clamping means being positioned for clampingly engaging the sleeve thereby subdividing the sleeve into a central portion for containing said stack of articles and first and second opening end flap portions extending from opposed ends of the central portion; cutter means disposed intermediate the continuous sleeve supply and said second clamping means for cutting the sleeve to separate the package being formed from the sleeve supply thereby forming a new open end thereon; means for forming said sleeve end flaps so as to form a double ended package with said stacked articles being confined to said central portion thereof; and transfer means for removing said double-ended package from the area in which said package ends are formed.

19. An apparatus as defined in claim 18, wherein the articles in said stack are substantially identical.

20. An apparatus as defined in claim 18, wherein the stack of articles includes a plurality of substantially identical articles arrayed in end to end relation.

21. An apparatus as defined in claim 18, wherein the stack of articles includes a plurality of substantially identical articles arrayed in telescoping end to end relation.

22. An apparatus as defined in claim 18, wherein the stack of articles has an elongate generally cylindrical configuration.

23. An apparatus as defined in claim 18, wherein said stack receiving means includes an elongate track having a channel defined therein configured to closely slidably receive a stack of articles, said channel having an open end at said insertion station.

24. An apparatus as defined in claim 23, wherein said track further includes a deflectable support finger extending adjacent the open end of the channel for supporting a stack of articles placed in said channel.

25. An apparatus as defined in claim 18, further comprising means for successively delivering additional individual stacks of articles to said stack receiving means.

26. An apparatus as defined in claim 18, wherein said end gripper means includes an elongate insertion guide tube having an inlet end and an opposed outlet end, said guide tube having an inner diameter sized and configured to closely surround a stack of articles and to permit slidable passage of said stack therethrough, the inlet end being aligned with the stack-receiving means and the outlet end having an outer circumferential margin portion adapted to slidably receive the open end of said sleeve thereon.

27. An apparatus as defined in claim 26, wherein the end gripper means further includes a plurality of radially spaced apart circumferentially mounted gripper fingers extending adjacent said guide tube, each gripper finger having a free end with a gripping pad, each gripper finger being movable between an open, release position wherein the gripping pads are spaced from the outer circumferential margin portion of the outlet end and a closed, gripping position wherein the gripping pads are biased toward said outer circumferential margin portion to grippingly engage the open end of a sleeve positioned on the outlet end between the gripping pads and the outer margin portion of said guide tube, and means for moving the gripper arms between said open, release position and said closed, gripping position.

28. An apparatus as defined in claim 27, wherein said gripper arms are pivotally mounted adjacent said guide tube.

29. An apparatus as defined in claim 28, wherein each of said gripper arms includes an opposing end having cam follower means and the gripper arms are pivotally mounted intermediate the cam follower means and the gripping pad.

30. An apparatus as defined in claim 29, wherein said end gripper means further includes first spring biasing means directed against each said gripper arm at a point intermediate the pivotal mounting and the cam follower means and effective to maintain the gripper arms in a normally open, release position.

31. An apparatus as defined in claim 30, wherein said cam follower means comprise rotatably mounted rollers.

32. An apparatus as defined in claim 30, wherein said end gripper means further includes an annular piston mounted on said guide tube intermediate the cam follower ends of said gripper arms and the inlet end, the annular piston including a like plurality of cam surfaces defined in one side thereof which are aligned in opposition to said cam followers, said piston being movable between a retracted position wherein the cam surfaces are spaced from the cam followers and an extended position wherein the cam surfaces are advanced toward the cam followers to cammingly engage and move the cam followers along the cam surfaces until the gripper arms are simultaneously moved to said closed, gripping position, and means for reciprocatably moving the annular piston between the retracted and extended positions.

33. An apparatus as defined in claim 32, wherein said means for reciprocally moving the annular piston includes an elongate annular housing surrounding an intermediate portion of the guide tube having an annular pressurizable chamber defined therein between radially inner and radially outer cylindrical surfaces, said annular piston being received within said chamber, second spring biasing means mounted in said housing opposite the chamber and positioned to move the piston to said retracted position and means for pressurizing air in said chamber to move the piston to said extended position.

34. An apparatus as defined in claim 33, wherein said gripper arms are pivotally mounted to said annular housing.

35. An apparatus as defined in claim 34, wherein said first spring biasing means are mounted to said annular housing.

36. An apparatus as defined in claim 33, wherein said means for pressurizing air in said chamber includes a selectively energizable compressed air source connected by a tube and fitting to said chamber.

37. An apparatus as defined in claim 18, wherein said continuous sleeve supply includes a continuous tubular sleeve of packaging material folded in a lie-flat condition.

38. An apparatus as defined in claim 37, wherein the packaging material is Kraft paper.

39. An apparatus as defined in claim 38, wherein said sleeve of packaging material folded in its lie-flat condition includes a pair of re-entrant gussets folded inwardly on themselves.

40. An apparatus as defined in claim 37, which further includes a reel carrier, said continuous tubular sleeve supply being wound around said reel carrier.

41. An apparatus as defined in claim 37, wherein said sleeve feeder means includes expander means for expanding the open end of the sleeve from a folded condition adjacent the continuous sleeve supply to an expanded, unfolded condition adjacent the end gripper means.

42. An apparatus as defined in claim 41, wherein said expander means includes a mandrel having an outer surface defined by an elongate, generally cylindrical intermediate portion, a tapered conical end portion extending from one side of the intermediate portion and a forward body portion extending from the opposite side of the intermediate portion, said mandrel being positioned inside the free end of the packaging sleeve tapered end first so that the sleeve is received over the outer surface of the mandrel.

43. An apparatus as defined in claim 42, wherein said sleeve feeder means further includes a sleeve shuttle assembly including: an outer elongate tubular guide having an inner surface defining an inner diameter adapted to receive the mandrel and the sleeve intermediate the outer surface of the mandrel and said inner surface; cooperating means on said mandrel and said outer tubular guide for maintaining the mandrel in a fixed position within said outer tubular guide, reciprocable drive means for advancing the tubular guide from a position adjacent the continuous sleeve supply to a position adjacent said insertion station and for withdrawing the tubular guide from a position adjacent the insertion station to a position adjacent the sleeve supply; releasable locking means for fixing the free end of said sleeve with respect to the outer tubular guide and mandrel during advance of the tubular guide and for releasing the free end of the sleeve upon withdrawal of the tubular guide.

44. An apparatus as defined in claim 43, wherein said cooperating means includes a plurality of radially spaced apart pairs of rollers defined in the intermediate portion of the outer surface of the mandrel, each said pair of rollers defining a nip therebetween; and a plurality of opposing individual rollers mounted to said outer tubular guide and extending inwardly from said inner surface, said individual rollers being biased against and received in the nip of a said pair of rollers provided in the mandrel.

45. An apparatus as defined in claim 44, wherein said outer tubular guide includes a plurality of radially spaced apart, axially extending slots defined therein and said releasable locking means includes a plurality of radially spaced apart claw assemblies, each claw assembly including a claw pawl having a saw toothed surface at one end and a cam surface at the opposed end, said claw pawls being pivotally mounted to said outer tubular guide in such manner that the saw toothed surface of each pawl is normally received through a slot and biasingly engages the sleeve against the outer surface of the mandrel.

46. An apparatus as defined in claim 45, wherein said mandrel includes a plurality of radially spaced apart grooves defined in said forward body portion aligned with the slots in the tubular guide and the saw toothed surfaces of said pawls are normally received in said grooves.

47. An apparatus as defined in claim 46, wherein said releasable locking means further includes means for engaging the cam surfaces of said pawls during withdrawal of the tubular guide in such manner that the pawls are pivoted so that their saw toothed surfaces are moved out of said grooves and said slots, respectively.

48. An apparatus as defined in claim 42, wherein the forward body portion of the mandrel includes means for urging the open end of the sleeve over the outlet end of the insertion guide tube at the insertion station.

49. An apparatus as defined in claim 48, wherein said means for urging are provided by the forward body portion of the mandrel including a free end portion having an end surface and a cylindrical socket extending axially inwardly from said end surface, and a sleeve support having a generally cylindrical configuration with a raised peripheral lip and tapered surfaces extending outwardly from one end thereof, said sleeve support being telescopically received in said socket and with the peripheral lip extending outside the socket and being mounted for reciprocable axial movement within said socket, compressible biasing means for maintaining the sleeve support in a normally extended position wherein said peripheral lip is spaced forwardly from said end surface and is inwardly compressible to a retracted position wherein the peripheral lip is disposed adjacent the end surface of the free end portion, said open end of said sleeve being lockingly engaged by the claw pawls of the tubular guide so that said open end extends over the extended sleeve guide between the peripheral lip and the end surface whereby the sleeve feeder means may be advanced until the peripheral lip of the sleeve support abuttingly engages the outlet end of the insertion guide tube at said insertion station and whereby further advance of the outer tubular guide causes compressive movement of the sleeve guide to its retracted position and the open end of the sleeve is cammed outwardly by the tapered surfaces of the peripheral lip so that the open end of said sleeve is received over the outer circumferential margin portion of the outlet end of the insertion guide tube.

50. An apparatus as defined in claim 49, wherein after the open end of said sleeve is positioned on the outer circumferential margin portion, the gripper fingers of the end gripper means are actuated to said closed gripping position and subsequent withdrawal of the tubular guide causes movement of the mandrel within the gripped sleeve such that the tapered conical end portion of the mandrel unfolds and expands a trailing segment of said sleeve to provide a pre-expanded length of sleeve for receiving a stack of articles.

51. An apparatus as defined in claim 18, wherein said first and said second clamping means each includes an upper blade and a lower blade in opposing vertically aligned relation, said blades being movable between a closed position wherein the upper and lower blades are in abutting face to face relationship and an open position wherein said upper and lower blades are spaced apart by a distance greater than the diameter of said sleeve.

52. An apparatus as defined in claim 18, further including means for supporting said sleeve before, during and after stack insertion, said supporting means being disposed intermediate said first and second clamping means and being adapted to support the weight of a sleeve when filled.

53. An apparatus as defined in claim 52, wherein said sleeve support means includes an elongate tray member having an L-shaped configuration including a horizontal portion having an upper surface for supportingly receiving the central portion of the sleeve thereon.

54. An apparatus as defined in claim 53, wherein said apparatus has a longitudinal axis along which article insertion takes place, said axis extending through said insertion station and being bisected by said insertion station, said apparatus being thereby divided into an article side portion and a sleeve side portion, said stack-receiving means and said inserter means each being aligned with and located along said article side of said axis and said end gripper means, said continuous sleeve supply and said cutter means each being aligned with and located along said sleeve side of the insertion axis.

55. An apparatus as defined in claim 54, further including an unloading station whereat said double ended packages are removed from said tray member, said unloading station being laterally spaced from and extending parallel to the sleeve side of the insertion axis.

56. An apparatus as defined in claim 55, wherein said sleeve support means further includes a subframe having a front edge portion extending parallel to the sleeve side of the insertion axis and disposed between the cutter means and the end gripper means, said subframe being mounted for lateral movement toward and away from the sleeve side of the insertion axis, said first and second clamping means being fixedly mounted to said subframe so that their respective upper and lower clamping blade portions project normally from the forward edge portion of the subframe toward the sleeve side of the insertion axis, said elongate sleeve support tray being movably mounted to said movable subframe and being positioned so that the horizontal portion of said tray extends parallel to the sleeve side of the insertion axis intermediate the first and second clamping means, said subframe being movable between a fully retracted position wherein said sleeve support tray is aligned with the first and second clamping means and both are spaced away from the sleeve side of the insertion axis and spaced away from the unloading station such that the unloading station extends intermediate the fully retracted subframe and the sleeve side of the insertion axis, an unloading position wherein the subframe and said first and second clamping means are spaced away from the unloading station and the sleeve support tray is aligned with the unloading station; a partly-retracted position wherein said first and second clamping means and said tray are aligned with each other and aligned with the unloading station and an article-receiving position wherein said first and second clamping means and said tray are aligned with each other and aligned with the sleeve side of the insertion axis; and means for moving said subframe between said article receiving, partially retracted, unloading and fully-retracted positions; and means for moving the sleeve support tray with respect to said subframe.

57. An apparatus as defined in claim 58, wherein said means for moving the sleeve support tray includes lost motion means permitting the tray to remain aligned with the unloading station as said subframe is moved from said partially retracted position to its unloading position spaced away from the unloading station.

58. An apparatus as defined in claim 57, wherein said end forming means includes a pair of spaced apart stationary plow members disposed adjacent said first and second clamping means and opposite the sleeve support tray, each said plow member having an elongate body defined between a forward edge disposed adjacent the sleeve side of the insertion axis and a rearward edge extending beyond the unloading station and extending substantially perpendicularly with respect to said insertion axis, each said plow member further including an inward twist profile defining an end flap engaging surface including a gradually curved 90° transition from a front horizontal orientation to a rearward verticle orientation, whereby, upon cutting of the clamped sleeve and moving the subframe from its article receiving position to its partially retracted position, said first and second end flap portions of the sleeve are guided by the end flap engaging surfaces of the plow members from a horizontally extending position at the insertion station to a folded upright position at the unloading station.

59. An apparatus as defined in claim 58 further including unloader means disposed intermediate the sleeve side of the insertion axis and the unloading station adjacent the unloading station, said unloader means including an elongate horizontal package-receiving platform extending therefrom mounted for verticle reciprocal movement between a receiving position wherein said platform is aligned with the horizontal portion of said sleeve support tray positioned at said unloading station and a removing position wherein said platform is downwardly spaced from said receiving position, holder means for holding the package on the platform during movement of the platform; means for moving said platform between said receiving and said removing positions; said unloader means further including ejector means on said sleeve support tray for moving a package at the unloading station from the upper surface of the tray onto said package receiving platform.

60. An apparatus as defined in claim 18, further including taping means for taping the end flap portions of the sleeve against the central portion of the double ended package.

61. An apparatus as defined in claim 59, further including a taping station disposed along the vertical path of travel of said unloader platform intermediate said removing position and the unloading station whereat the opposed deformed end flap portions of the sleeve are taped against the central portion of the package; and taping means at said taping station for taping the end flaps to the central portion of the package.

62. An apparatus as defined in claim 61, wherein said taping means comprises a pair of tape applicator assemblies disposed at the taping station adjacent opposed ends of said unloader platform, each of said tape applicator assemblies including a taping head having an inwardly directed inverted L-shaped configuration including vertical lower arm portion and an upper arm portion cantilevered at one end from an upper end of the lower arm portion and extending to a spaced free end, said upper arm portion including a lower tape engaging surface defined between the free end and the lower arm portion, said taping head including means for releasably engaging a length of tape against said lower tape engaging surface, said tape head being mounted for reciprocal vertical and horizontal movement with respect to an adjacent end of a double ended package on said unloader platform positioned at said taping station; means for reciprocally horizontally moving said taping head between an inward taping position wherein the lower tape engaging surface overlies an end of the central portion of the package and a tape pickup station whereat said taping head is outwardly spaced from said package and; means for reciprocally vertically moving said taping head between a raised position wherein the tape engaging surface of the upper arm is spaced above the central portion of the package and a lowered position wherein the tape engaging surface of the upper arm pressingly engages the central portion of the package, and tape feeder means for successively feeding lengths of tape to the tape pickup station for pick up by the taping head.

63. An apparatus as defined in claim 62, wherein horizontal movement of a taping head from the tape pickup station to said taping position causes the free end of the upper arm to fold over a top portion of the upstanding end flap against the central portion of the package preparatory to taping.

64. An apparatus as defined in claim 62, wherein said means for releasably engaging a length of tape includes vacuum means.

65. An apparatus as defined in claim 63 wherein said length of tape is longer than said tape engaging surface and includes a trailing end portion extending outwardly from said lower arm portion opposite the upper arm and said tape head includes means for affixing said trailing end portion against an outer surface of said folded end flap extending over a said end of the central portion.

66. An apparatus as defined in claim 65, wherein said affixing means comprises a biasing roller mounted for movement along a package facing surface of said lower arm to pressingly engage the trailing portion of said tape against the outer surface of said folded end flap between a retracted position wherein said roller is located within a recess defined in the tape engaging surface of the upper arm immediately adjacent said package facing surface and above the trailing end of said tape and an extended lowered position wherein said roller is located adjacent a lower portion of said package facing surface and means for moving the roller between said retracted and said extended positions.

67. An apparatus as defined in claim 18, further comprising a stack pick up station whereat pre-formed stacks of articles are staged, and stack delivery means for successively delivering said stacks of articles one at a time from the stack pick up station to the stack receiving means; said stack delivery means including releasable stack gripper means for gripping and maintaining a said stack of articles in the stack delivery means during movement thereof.

68. An apparatus as defined in claim 67 wherein said stack pick up station is laterally spaced from and extends parallel to said stack receiving means.

69. An apparatus as defined in claim 68, further including a plurality of elongate, parallel spaced-apart guide channels configured to closely slidably receive a continuous incoming stream of articles, each guide channel including an article receiving end and an opposed article staging end positioned at said stack pick up station, each said article staging end including a fixed stop means and movable stop means mounted to said guide channel at a point spaced from the fixed stop means and intermediate the fixed stop means and the article receiving end each said movable stop means including finger means movable between a stop position wherein the finger extends into the guide channel and a retracted position wherein the finger is withdrawn from the guide channel each said article staging end extending parallel to said stack receiving means.

70. An apparatus as defined in claim 18, wherein said sleeve feeder means and said inserter means include reciprocable tol-o-matic cylinder drive means.

* * * * *